US007623073B2

(12) United States Patent
Teshirogi et al.

(10) Patent No.: US 7,623,073 B2
(45) Date of Patent: Nov. 24, 2009

(54) LINEARLY POLARIZED ANTENNA AND RADAR APPARATUS USING THE SAME

(75) Inventors: Tasuku Teshirogi, Tokyo (JP); Aya Hinotani, Atsugi (JP); Takashi Kawamura, Atsugi (JP)

(73) Assignee: Anritsu Corporation, Atsugi-Shi (JP)

( * ) Notice: Subject to any disclaimer, the term of this patent is extended or adjusted under 35 U.S.C. 154(b) by 146 days.

(21) Appl. No.: 11/794,872

(22) PCT Filed: Nov. 14, 2005

(86) PCT No.: PCT/JP2005/020858

§ 371 (c)(1),
(2), (4) Date: Jul. 5, 2007

(87) PCT Pub. No.: WO2007/055028

PCT Pub. Date: May 18, 2007

(65) Prior Publication Data

US 2007/0290939 A1 Dec. 20, 2007

(51) Int. Cl.
*H01Q 1/38* (2006.01)

(52) U.S. Cl. ..... 343/700 MS; 343/846

(58) Field of Classification Search ..... 343/700 MS, 343/846

See application file for complete search history.

(56) References Cited

U.S. PATENT DOCUMENTS

| | | | | |
|---|---|---|---|---|
| 4,069,483 | A | 1/1978 | Kaloi | |
| 6,181,279 | B1 * | 1/2001 | Van Hoozen | 343/700 MS |
| 6,218,610 | B1 | 4/2001 | Suzuki | |
| 6,768,469 | B2 | 7/2004 | Hager et al. | |

(Continued)

FOREIGN PATENT DOCUMENTS

| | | | |
|---|---|---|---|
| JP | 10-319117 | A | 12/1998 |

(Continued)

OTHER PUBLICATIONS

FCC; First Order and Report; 02-48; New Part 15 Rules.

(Continued)

*Primary Examiner*—Hoang V Nguyen
(74) *Attorney, Agent, or Firm*—Frishauf, Holtz, Goodman & Chick, P.C.

(57) ABSTRACT

A linearly polarized antenna includes a dielectric substrate, a ground conductor which is overlapped on one surface of the dielectric substrate, an antenna element made of linearly polarized, which is formed on an opposite surface of the dielectric substrate, a plurality of metal posts in which one end side of each of the plurality of metal posts is connected to the ground conductor, the plurality of metal posts piercing through the dielectric substrate along a thickness direction thereof, another end side of each of the plurality of metal posts being extended to the opposite surface of the dielectric substrate, the plurality of metal posts being provided at predetermined intervals to form a cavity so as to surround the antenna element, and a conducting arm which short-circuits the other end of the plurality of metal posts along a line direction of the plurality of metal posts on the opposite surface side of the dielectric substrate, the conducting arm being provided while extended by a predetermined distance toward a direction of the antenna element, the conducting arm having a triangular portion.

24 Claims, 13 Drawing Sheets

U.S. PATENT DOCUMENTS

| | | | | |
|---|---|---|---|---|
| 6,801,167 | B2 * | 10/2004 | Shibata | 343/700 MS |
| 7,057,564 | B2 * | 6/2006 | Tsai et al. | 343/700 MS |
| 7,079,078 | B2 * | 7/2006 | Yuanzhu | 343/700 MS |
| 2004/0012529 | A1 | 1/2004 | Teshirogi et al. | |

FOREIGN PATENT DOCUMENTS

| | | | |
|---|---|---|---|
| JP | 11-17377 | A | 1/1999 |
| JP | 11-308044 | A | 11/1999 |
| JP | 3192699 | B2 | 5/2001 |
| JP | 2002-43838 | A | 2/2002 |
| JP | 2003-87045 | A | 3/2003 |
| JP | 2005-525735 | A | 8/2005 |
| WO | WO 03/021824 | A1 | 3/2003 |

OTHER PUBLICATIONS

FCC; Second Report and Order and Second Memorandum Opinion and Order; 04-285.

T. Teshirogi et al; Residual-Carrier-Free Burst Oscillator for Automotive UWB Radar Applications; Electronics Letters, April 28, 2005; vol. 41, No. 9.

International Preliminary Report on Patentability, Chapter I of the Patent Cooperation Treaty, and Written Opinion for PCT/JP2005/020858, dated May 22, 2008. 6 sheets.

* cited by examiner

LINEARLY POLARIZED ANTENNA AND RADAR APPARATUS USING THE SAME

This application is a U.S. National Phase Application under 35 USC 371 of International Application PCT/JP2005/020858 filed Nov. 14, 2005.

TECHNICAL FIELD

The present invention relates to a linearly polarized antenna in which a technique for realizing high performance, high productivity, and cost reduction is adopted and a radar apparatus using the linearly polarized antenna, and particularly to a linearly polarized antenna suitable to a UWB (Ultra-wideband) radar which will be used as an automotive radar in the future and a radar apparatus using the linearly polarized antenna.

BACKGROUND ART

It has been mainly proposed that UWB in which a submillimeter wave band ranging from 22 to 29 GHz is used is utilized as a vehicle-mounted or portable short-range radar (SRR).

It is necessary that an antenna of the radar apparatus used in the UWB have a broadband radiation characteristic, and that the antenna have a compact and thin type planar structure considering the fact that the antenna is placed in a gap between an automobile body and a bumper when mounted on the vehicle.

It is also necessary that the antenna make an exploration with a weak radio wave defined by the UWB, and the low-loss and high-gain antenna is required to suppress useless power consumption such that the antenna can be driven by a battery. Therefore, it is necessary that the arrayed antenna can easily be achieved.

For the purpose of the cost reduction, in the antenna, desirably a feed unit of an antenna element can be produced by a pattern printing technique.

As described above, the frequency band of 22 to 29 GHz is used for the UWB radar. However, the frequency band of 22 to 29 GHz includes an RR radio-wave emission prohibited band (23.6 to 24.0 GHz) for protecting a passive sensor of radio astronomy or earth exploration satellite service (EESS).

In 2002, in Non-Patent Document 1, FCC (Federal Communications Commission of USA) discloses a rule in which average power density is not more than −41.3 dBm and peak power density is set to 0 dBm/50 MHz in the frequency band of 22 to 29 GHz.

The rule also stipulates that an elevation-angle side lobe is decreased from −25 dB to −35 dB every few years in order to suppress radio interference to EESS.

Non-Patent Document 1: FCC 02-48 New Part 15 Rules, FIRST REPORT AND ORDER

However, in order to realize the decrease in elevation-angle side lobe, a dimension is increased in a perpendicular direction of the antenna used in the UWB radar, and it is envisioned that the antenna is hardly mounted in a general passenger car.

Therefore, in 2004, FCC adds a revised rule which is a method independent of the elevation-angle side lobe of the antenna as described in Non-Patent Document 2. In the revised rule, radiation power density of the RR radio-wave emission prohibited band is set to −61.3 dBm/MHz which is smaller than ever before by 20 dB.

Non-Patent Document 2: "Second Report and Order and Second Memorandum Opinion and Order" FCC 04-285, Dec. 16, 2004

A method of turning on and off a continuous wave (CW) from a continuous oscillator using a semiconductor switch is adopted in the conventional UWB radar.

In the method, a large residual carrier is generated due to incompleteness of switch isolation. Therefore, as shown by a broken line of FIG. 18, the residual carrier is evacuated to an SRD (Short Range Device) band ranging from 24.05 to 24.25 GHz which is allocated for a Doppler radar.

However, because the SRD band is extremely close to the RR radio-wave emission prohibited band, there is a serious problem that the interference with EESS and the like cannot be avoided.

In order to solve the problem, there has been proposed a method in which a burst oscillator shown in Non-Patent Document 3 is used as the UWB radar.

Non-Patent Document 3: "Residual-carrier free burst oscillator for automotive UWB radar applications", Electronics Letters, 28th Apr. 2005, Vol. 41, No. 9

The burst oscillator oscillates only when a pulse is on whereas the burst oscillator stops the oscillation when a pulse is off. Therefore, a residual carrier is not generated when the burst oscillator is used in the UWB radar.

Because any spectrum arrangement can be achieved, the band shown by a solid line of FIG. 18 can be used for the UWB radar, and as a result, the radiation power density can be suppressed to a sufficiently low level in the RR radio-wave emission prohibited band.

However, it is not easy to make the radiation power density 20 dB or more lower than a spectral peak only using the burst oscillator.

In this case, when the antenna has a characteristic in which the gain has a steep decline (notch) in the RR radio-wave emission prohibited band, the UWB radar which satisfies the new FCC rule can be realized by use of a combination of the antenna and the burst oscillator.

The invention is intended to provide an antenna suitable to the UWB radar which has the gain notch in the RR radio-wave emission prohibited band.

First of all, it is necessary that a broadband thin type planar antenna be realized as the antenna satisfying the various requirements.

As the thin type planar antenna, there is well known a so-called patch antenna having a configuration in which a rectangular or circular plate-like antenna element is formed on a dielectric substrate by patterning.

However, generally the patch antenna has a narrow band. In order to broaden the band, it is necessary to use a thick substrate having a low dielectric constant.

The low-loss substrate is required in order to use the antenna in the submillimeter wave band, and Teflon (registered trademark) is well known as such substrates.

However, because Teflon has difficulty in bonding a metal film, there is a problem that it is difficult to produce the antenna, resulting in cost increase.

Therefore, it is considered that a circularly polarized wave or a linearly polarized wave is used in the broadband element antenna necessary for UWB. In the case of the circularly polarized wave, there is an antenna such as a spiral antenna having the good characteristic.

However, the UWB antenna in which the linearly polarized wave is used is necessary because the circularly polarized wave cannot be used in the case of the vehicle-mounted short-range radar including a communication function. The realization of the short-range radar with the communication function is recently being studied.

In the case of the linearly polarized wave, there is a problem that it is not easy to obtain the broadband element antenna.

There is known a dipole antenna called bow-tie antenna as an element antenna of the relatively broadband linearly polarized wave. The dipole antenna is formed of a pair of triangles.

However, in the case where the bow-tie antenna is used as the array antenna, disturbance of the directivity is easily generated due to mutual connection between antennas.

A method of increasing the substrate thickness to about a quarter of a propagation wavelength is adopted in order to broaden the band in the planar antenna in which the dielectric substrate is used, and this method is effective in the case where the antenna is used as a single element.

However, in the array antenna in which the plural elements are arrayed, when the dielectric substrate is thickened, a surface wave propagating along the dielectric substrate surface is excited, which results in a problem that the elements are affected by the surface wave to hardly obtain the desired characteristic.

DISCLOSURE OF INVENTION

An object of the invention is to provide a linearly polarized antenna and a radar apparatus using the same. In the linearly polarized antenna, the influence of the surface wave is suppressed to obtain the good radiation characteristic in the broadband, the radiation is suppressed in the RR radio-wave emission prohibited band, and the high productivity and cost reduction can be realized.

In order to achieve the above object, a first aspect of the present invention provides a linearly polarized antenna comprising:

a dielectric substrate (21, 21', 21");

a ground conductor (22, 22') which is overlapped on one surface of the dielectric substrate;

an antenna element (23, 23') made of linearly polarized, which is formed on an opposite surface of the dielectric substrate;

a plurality of metal posts (30) in which one end side of each of the plurality of metal posts is connected to the ground conductor, and pierces through the dielectric substrate along a thickness direction thereof, another end side of each of the plurality of metal posts being extended to the opposite surface of the dielectric substrate, the plurality of metal posts being provided at predetermined intervals to form a cavity so as to surround the antenna element; and a conducting rim (32, 32') which short-circuits the other end side of each of the plurality of metal posts along a line direction of the plurality of metal posts on the opposite surface side of the dielectric substrate, the conducting rim being provided while extended by a predetermined distance toward a direction of the antenna element.

In order to achieve the above object, a second aspect of the present invention provides the linearly polarized antenna according to the first aspect, wherein the antenna element is formed by a dipole antenna element having a pair of input terminals (25*a*, 25*b*), the linearly polarized antenna further comprises a feed pin (25) in which one end side is connected to one of the pair of input terminals of the dipole antenna element while another end side is provided to pierce through the dielectric substrate and the ground conductor, and another of the pair of input terminals of the dipole antenna element pierces through the dielectric substrate to short-circuit the ground conductor.

In order to achieve the above object, a third aspect of the present invention provides the linearly polarized antenna according to the first aspect, wherein the conducting rim (32, 32') has at least a pair of uneven-width portions which are across the antenna element from each other.

In order to achieve the above object, a fourth aspect of the present invention provides the linearly polarized antenna according to the third aspect, wherein the pair of uneven-width portions is a pair of triangular portions.

In order to achieve the above object, a fifth aspect of the present invention provides the linearly polarized antenna according to the third aspect, wherein a plurality of sets of the antenna element formed on the dielectric substrate and a plurality of sets of the feed pin in which one end of the feed pin is connected to one of the pair of input terminals of the antenna element are provided, the plurality of metal posts constituting the cavity and the conducting rim are formed in a lattice shape so as to surround the plurality of sets of the antenna element, and the linearly polarized antenna further comprises a feed unit (40) which is provided on the side of the ground conductor to distribute and feed an excitation signal to the plurality of sets of the antenna element through the plurality of sets of the feed pin.

In order to achieve the above object, a sixth aspect of the present invention provides the linearly polarized antenna according to the fifth aspect, wherein the feed unit is formed by a feeding dielectric substrate (41) and a microstrip feed line (42), the feeding dielectric substrate being provided on the side opposite the dielectric substrate across the ground conductor, the microstrip feed line being formed on a surface of the feeding dielectric substrate.

In order to achieve the above object, a seventh aspect of the present invention provides the linearly polarized antenna according to the second aspect, wherein the dipole antenna element is formed in a triangular shape having a predetermined base width $W_B$ and a predetermined height $L_B/2$, and the dipole antenna element constitutes a bow-tie antenna while vertexes thereof are arranged so as to face each other.

In order to achieve the above object, an eighth aspect of the present invention provides the linearly polarized antenna according to the second aspect, wherein the dipole antenna element is formed in a deformed rhombic shape having a predetermined projection width $W_B$ and a predetermined height $L_B/2$, and the dipole antenna element constitutes a bow-tie antenna while vertexes thereof are arranged so as to face each other.

In order to achieve the above object, a ninth aspect of the present invention provides the linearly polarized antenna according to the first aspect, wherein a first linearly polarized antenna element (23, 23') and a second linearly polarized antenna element (23, 23') are formed as the antenna element on the dielectric substrate (21"), one end side of each of the plurality of metal posts (30) is connected to the ground conductor, and pierces through the dielectric substrate along a thickness direction thereof, another end side of each of the plurality of metal posts is extended to the opposite surface of the dielectric substrate, the plurality of metal posts are provided at predetermined intervals to form separated cavities such that the plurality of metal posts surround the first linearly polarized antenna element and the second linearly polarized antenna element while separating the first linearly polarized antenna element and the second linearly polarized antenna element, and a first conducting rim (32) and a second conducting rim (32') are provided as the conducting rim (32, 32') on the opposite surface of the dielectric substrate, the first conducting rim and the second conducting rim short-circuiting the other end side of each of the plurality of metal posts along a line direction of the plurality of metal posts, the plurality of metal posts being provided at predetermined intervals so as to surround the first linearly polarized antenna element and the second linearly polarized antenna element while separating the first linearly polarized antenna element and the second linearly polarized antenna element, the first conducting rim and the second conducting rim being extended by a predetermined distance toward directions of the first linearly polarized antenna element and the second linearly polarized antenna element.

In order to achieve the above object, a tenth aspect of the present invention provides the linearly polarized antenna according to the ninth aspect, wherein one of the first linearly polarized antenna element and the second linearly polarized antenna element is applied as a transmitting antenna (51) of a radar apparatus (50) and another is applied as a receiving antenna (52) of the radar apparatus (50).

In order to achieve the above object, an eleventh aspect of the present invention provides the linearly polarized antenna according to any one of the first to tenth aspects, wherein a resonator is formed by the cavity and the conducting rim, structural parameters of the resonator and the antenna element are adjusted to set the resonator to a desired resonance frequency, and thereby a frequency characteristic is obtained such that a gain of the linearly polarized antenna is decreased in a predetermined range.

In order to achieve the above object, a twelfth aspect of the present invention provides the linearly polarized antenna according to the eleventh aspect, wherein the structural parameter includes at least one of a internal dimension Lw of the cavity, a rim width $L_R$ of the conducting rim, an overall length $L_B$ of the antenna element, and a horizontal width $W_B$ of the antenna element.

In order to achieve the above object, a thirteenth aspect of the present invention provides a radar apparatus (50) comprising:

a transmitting unit (54) which radiates a radar pulse to a space via a transmitting antenna (51);

a receiving unit (55) which receives the radar pulse wave reflected from an object existing in the space via a receiving antenna (52);

an analysis processing unit (56) which explores the object existing in the space based on a receiving output from the receiving unit; and a control unit (53) which controls at least one of the transmitting unit and the receiving unit based on an output from the analysis processing unit, wherein the transmitting antenna and the receiving antenna are respectively formed by first and second linearly polarized antenna elements (23, 23'), and the first and second linearly polarized antenna elements (23, 23') respectively include:

a dielectric substrate (21, 21', 21");

a ground conductor (22, 22') which is overlapped on one surface of the dielectric substrate;

an antenna element (23, 23') made of linearly polarized, which is formed on the opposite surface of the dielectric substrate;

a plurality of metal posts (30) in which one end side of each of the plurality of metal posts is connected to the ground conductor, and pierces through the dielectric substrate along a thickness direction thereof, another end side of each of the plurality of metal posts being extended to the opposite surface of the dielectric substrate, the plurality of metal posts being provided at predetermined intervals to form a cavity so as to surround the antenna element; and a conducting rim (32, 32') which short-circuits the other end side of each of the plurality of metal posts along a line direction of the plurality of metal posts on the opposite surface side of the dielectric substrate, the conducting rim being provided while extended by a predetermined distance in the direction of the antenna element, the one end side of each of the plurality of metal posts (30) is connected to the ground conductor, and pierces through the dielectric substrate along a thickness direction thereof, the other end of each of the plurality of metal posts is extended to the opposite surface of the dielectric substrate, the plurality of metal posts are provided at predetermined intervals to form separated cavities such that the plurality of metal posts surround the first linearly polarized antenna element and the second linearly polarized antenna element while separating the first linearly polarized antenna element and the second linearly polarized antenna element, and a first conducting rim (32) and a second conducting rim (32') are provided as the conducting rim (32, 32') on the opposite surface of the dielectric substrate, the first conducting rim and the second conducting rim short-circuiting the other end side of each of the plurality of metal posts along a line direction of the plurality of metal posts, the plurality of metal posts being provided at predetermined intervals so as to surround the first linearly polarized antenna element and the second linearly polarized antenna element while separating the first linearly polarized antenna element and the second linearly polarized antenna element, the first conducting rim and the second conducting rim being extended by a predetermined distance toward directions of the first linearly polarized antenna element and the second linearly polarized antenna element.

In order to achieve the above object, a fourteenth aspect of the present invention provides the radar apparatus (50) according to the thirteenth aspect, wherein the antenna element is formed by a dipole antenna element having a pair of input terminals (25*a*, 25*b*), the linearly polarized antenna further comprises a feed pin (25) in which one end side is connected to one of the pair of input terminals of the dipole antenna element while another end side is provided to pierce through the dielectric substrate and the ground conductor, and another of the pair of input terminals of the dipole antenna element pierces through the dielectric substrate to short-circuit the ground conductor.

In order to achieve the above object, a fifteenth aspect of the present invention provides the radar apparatus (50) according to the thirteenth aspect, wherein the conducting rim (32, 32') has at least a pair of uneven-width portions which are across the antenna element from each other.

In order to achieve the above object, a sixteenth aspect of the present invention provides the radar apparatus (50) according to the fifteenth aspect, wherein the pair of uneven-width portions is a pair of triangular portions.

In order to achieve the above object, a seventeenth aspect of the present invention provides the radar apparatus (50) according to the fourteenth aspect, wherein a plurality of sets of the antenna element formed on the dielectric substrate and a plurality of sets of the feed pin in which one end of the feed pin is connected to one of the pair of input terminals of the antenna element are provided, the plurality of metal posts constituting the cavity and the conducting rim are formed in a lattice shape so as to surround the plurality of sets of the antenna element, and the linearly polarized antenna further comprises a feed unit (40) which is provided on the side of the ground conductor to distribute and feed an excitation signal to the plurality of sets of the antenna element via the plurality of sets of the feed pin.

In order to achieve the above object, an eighteenth aspect of the present invention provides the radar apparatus (50) according to the seventeenth aspect, wherein the feed unit is formed by a feeding dielectric substrate (41) and a microstrip feed line (42), the feeding dielectric substrate being provided on the side opposite the dielectric substrate across the ground conductor, the microstrip feed line being formed on a surface of the feeding dielectric substrate.

In order to achieve the above object, a nineteenth aspect of the present invention provides the radar apparatus (50) according to the fourteenth aspect, wherein the dipole antenna element is formed in a triangular shape having a predetermined base width $W_B$ and a predetermined height $L_B/2$, and the dipole antenna element constitutes a bow-tie antenna while vertexes thereof are arranged so as to face each other.

In order to achieve the above object, a twentieth aspect of the present invention provides the radar apparatus (50) according to the fourteenth aspect, wherein the dipole antenna element is formed in a deformed rhombic shape having a predetermined projection width $W_B$ and a predetermined height $L_B/2$, and the dipole antenna element constitutes a bow-tie antenna while vertexes thereof are arranged so as to face each other.

In order to achieve the above object, a twenty-first aspect of the present invention provides the radar apparatus (50) according to any one of the thirteenth to twentieth aspects, wherein a resonator is formed by the cavity and the conducting rim, structural parameters of the resonator and the antenna element are adjusted to set the resonator to a desired resonance frequency, and thereby a frequency characteristic is obtained such that a gain of the linearly polarized antenna is decreased in a predetermined range.

In order to achieve the above object, a twenty-second aspect of the present invention provides the radar apparatus (50) according to the twenty-first aspect, wherein the structural parameter includes at least one of a internal dimension Lw of the cavity, a rim width $L_R$ of the conducting rim, an overall length $L_B$ of the antenna element, and a horizontal width $W_B$ of the antenna element.

In the linearly polarized antenna of the invention having the above configuration, the plurality of metal posts piercing through the dielectric substrate are arranged so as to surround the antenna element, and thereby the cavity structure is formed. Additionally, the one end of each of the plurality of metal posts is short-circuited along the line direction, and the conducting rim (rim/conducting rim) is provided while extended by the predetermined distance in the antenna element direction. Therefore, the generation of the surface wave can be suppressed and the antenna can be set to the desired radiation characteristic.

In the linearly polarized antenna of the invention, the frequency characteristic of the antenna gain can be set so as to have the steep decline (notch) in the RR radio-wave emission prohibited band by utilizing the resonance phenomenon of the cavity, which effectively decreases the radio interference with EESS or the radio astronomy service.

In the linearly polarized antenna of the invention, a fluctuation in characteristic caused by the influence of the surface wave between the antenna elements can be prevented even if the antenna is arrayed.

BEST MODE FOR CARRYING OUT THE INVENTION

Some embodiments of the invention will be described below with reference to the drawings.

First Embodiment

FIGS. 1 to 5 show a basic structure of a linearly polarized antenna 20 according to a first embodiment of the invention.

Figure 1:
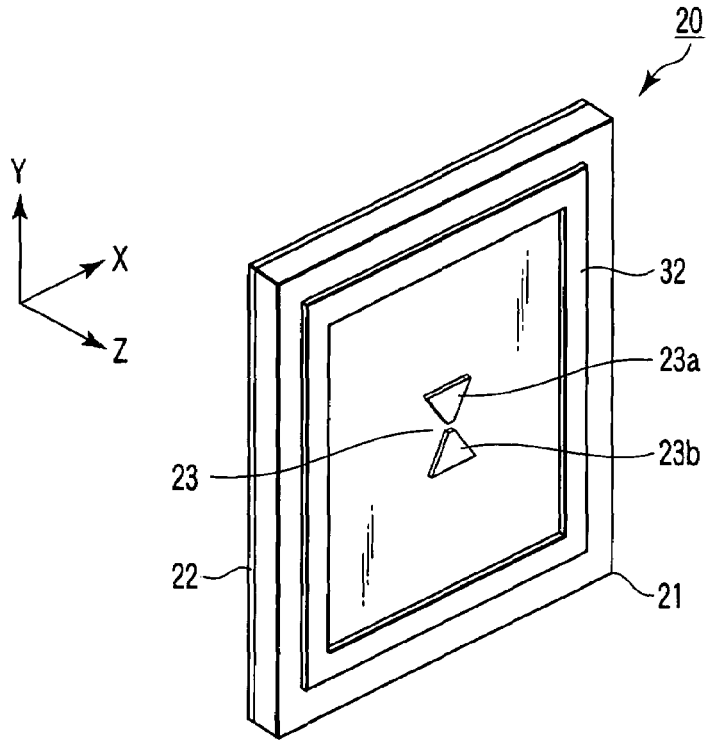
FIG. 1 is a perspective view showing a configuration of a linearly polarized antenna according to a first embodiment of the invention.

FIG. 1 is a perspective view showing a configuration of the linearly polarized antenna according to the first embodiment of the invention.

Figure 2:
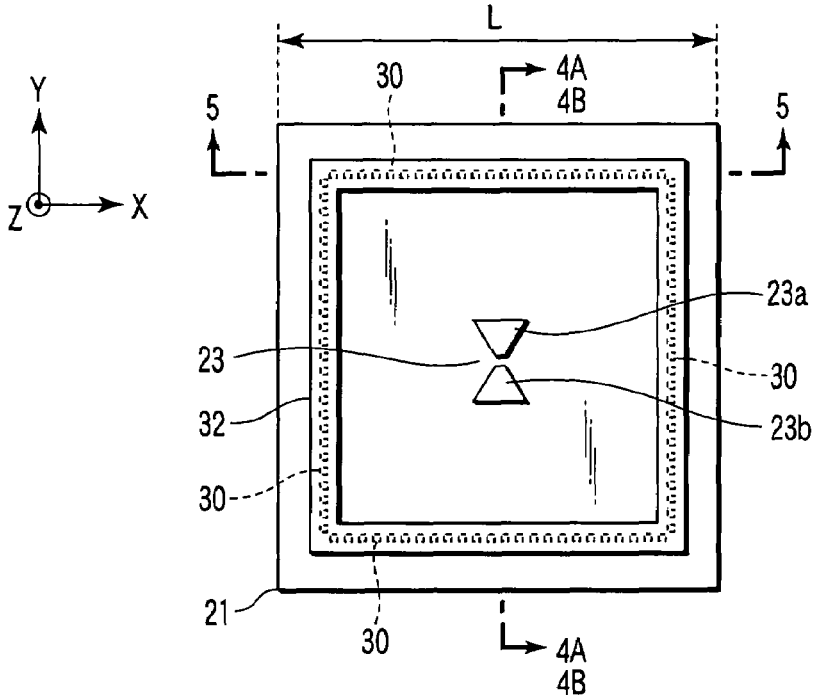
FIG. 2 is a front view showing the configuration of the linearly polarized antenna according to the first embodiment of the invention.

FIG. 2 is a front view showing the configuration of the linearly polarized antenna according to the first embodiment of the invention.

Figure 3:
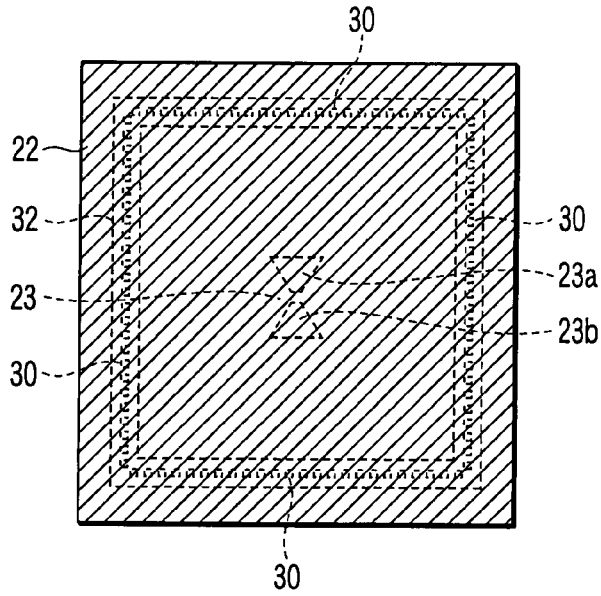
FIG. 3 is a rear view showing the configuration of the linearly polarized antenna according to the first embodiment of the invention.

FIG. 3 is a rear view showing the configuration of the linearly polarized antenna according to the first embodiment of the invention.

Figure 4A:
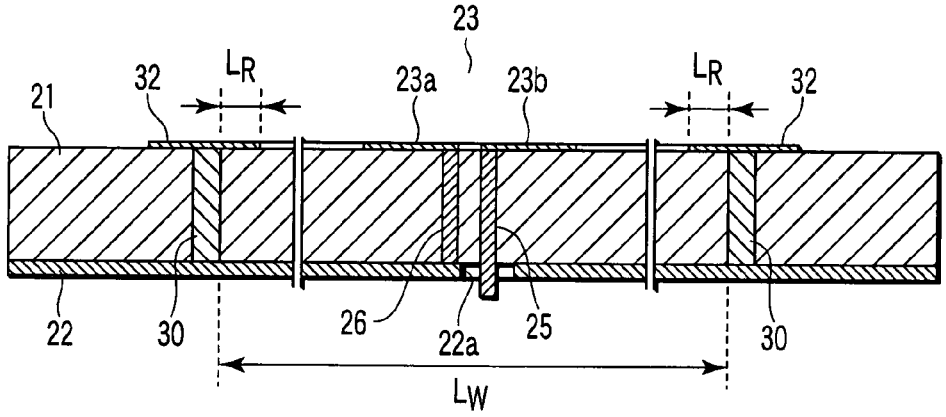
FIG. 4A is an enlarged sectional view taken on a line 4A-4A of FIG. 2.

FIG. 4A is an enlarged sectional view taken on a line 4A-4A of FIG. 2.

Figure 4B:
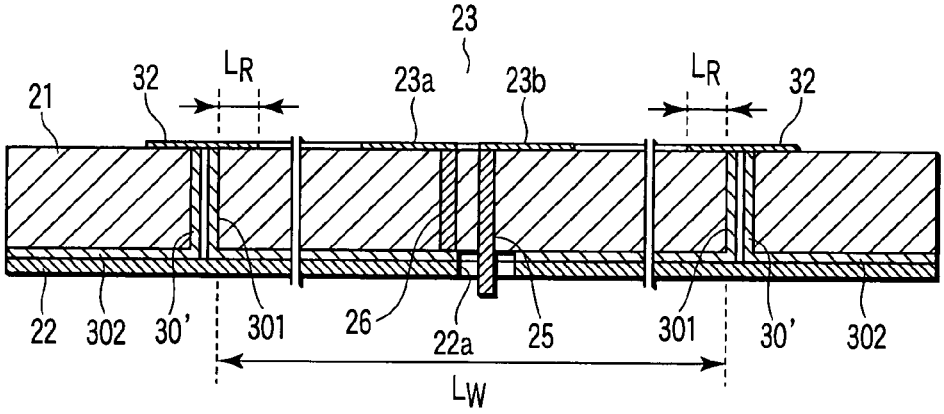
FIG. 4B is an enlarged sectional view taken on a line 4B-4B in a modification of FIG. 2.

FIG. 4B is an enlarged sectional view taken on a line 4B-4B in a modification of FIG. 2.

Figure 5:
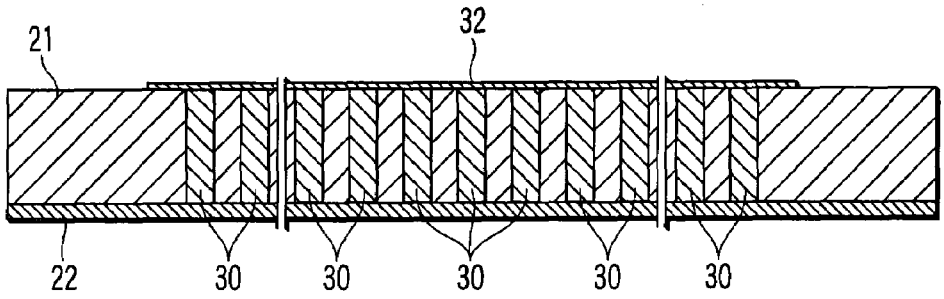
FIG. 5 is an enlarged sectional view taken on a line 5-5 of FIG. 2.

FIG. 5 is an enlarged sectional view taken on a line 5-5 of FIG. 2.

Basically, as shown in FIGS. 1 to 5, the linearly polarized antenna of the invention includes a dielectric substrate 21, a ground conductor 22, a linearly polarized antenna element 23, a plurality of metal posts 30, and a conducting rim 32. The ground conductor 22 is overlapped on one surface side of the dielectric substrate 21. The linearly polarized antenna element 23 is formed on the opposite surface of the dielectric substrate 21. One end side of each of the plurality of metal posts 30 is connected to the ground conductor 22, and pierces through the dielectric substrate 21 in a thickness direction thereof. Another end side of each of the plurality of metal posts 30 is extended to the opposite surface of the dielectric substrate 21. The plurality of metal posts 30 are provided at predetermined intervals so as to surround the antenna element 23, which constitutes a cavity. On the opposite surface of the dielectric substrate 21, the other end side of each of the plurality of metal posts 30 is short-circuited along a line direction of the plurality of metal posts 30. The conducting rim 32 is provided while extended by a predetermined distance in a direction of the antenna element 23.

Specifically, the linearly polarized antenna 20 is a substrate made of a material having a low dielectric constant (around 3.5). For example, the linearly polarized antenna 20 includes the dielectric substrate 21 having a thickness of 1.2 mm, the ground conductor 22 provided on one surface side (rear surface in FIGS. 1 and 2) of the dielectric substrate 21, a dipole antenna element 23, one feed pin 25, and one short pin 26. The dipole antenna element 23 is formed by a pair of element antennas 23*a* and 23*b*. The pair of element antennas 23*a* and 23*b* excites the cavity with a linearly polarized wave, and is formed on the opposite surface of the dielectric substrate 21 (front surface in FIGS. 1 and 2) by a pattern printing technique. The feed pin 25 and the short pin 26 feed a power to the antenna element 23.

The feed pin 25 and the short pin 26 pierce through the dielectric substrate 21 in the thickness direction thereof, the feed pin 25 further pierces through a hole 22*a* of the ground conductor 22, and the short pin 26 is short-circuited to the ground conductor 22.

Because the dipole antenna element 23 is an antenna of a balanced type element, balanced feed can be performed.

In such cases, instead of the one feed pin 25 and the one short pin 26, two feed pins may be provided to pierce through two holes made in the ground conductor 22.

However, frequently the power is fed to the antenna using a coaxial line or a microstrip line.

Because the coaxial line and the microstrip line are so-called unbalanced lines, it is necessary to insert a balun between the feed pin and the antenna when the power is fed to the antenna of the balanced element such as the dipole antenna element 23.

However, when the broadband characteristic necessary to UWB is realized, it is impractical because the balun is significantly enlarged.

In the invention, in order to solve the problem, as described above, the power is fed to the element antenna 23*b* of the pair of element antennas 23*a* and 23*b* constituting the dipole antenna element 23 through the feed pin 25 using the coaxial cable, the coplanar line in which the ground conductor 22 is set to a ground line, or the later-mentioned microstrip line, and the other element antenna 23*a* is short-circuited to the ground conductor 22 through the short pin 26. Therefore, even if the feed line is substantially the unbalanced type, the power can be fed without using the balun.

Consequently, the radiowave of the linearly polarized wave can be radiated from the antenna element 23.

The dielectric substrate 21 can be made of a material such as RO4003 (product of Rogers company) having the low-loss in the submillimeter wave band.

The dielectric substrate 21 can be made of a low-loss material whose dielectric constant ranges from about 2 to about 5, and examples of the material include a glass fabrics Teflon substrate and various thermoset resin substrates.

However, in the linearly polarized antenna having only the above structure, because the surface wave is excited along the surface of the dielectric substrate 21 as described above, the desired characteristic of the linearly polarized antenna is not obtained by the influence of the surface wave.

Therefore, in the linearly polarized antenna 20 of the first embodiment, as shown in FIGS. 4A and 5, the cavity structure is adopted in addition to the above structure. For example, a plurality of cylindrical metal posts 30 are provided at predetermined intervals so as to surround the antenna element 23, which forms the cavity structure. One end side of each of the plurality of cylindrical metal posts 30 is connected to the ground conductor 22, and pierces through the dielectric substrate 21. Another end side of each of the plurality of cylindrical metal posts 30 is extended to the opposite surface of the dielectric substrate 21.

Furthermore, in the linearly polarized antenna 20 of the first embodiment, a conducting rim 32 is provided on the opposite surface of the dielectric substrate 21 in addition to the cavity structure. The other end side of each of the plurality of metal posts 30 is sequentially short-circuited along the line direction by the conducting rim 32, and the conducting rim 32 is extended by the predetermined distance toward the direction of the antenna element 23 from a connection point to each of the plurality of metal posts 30.

In the linearly polarized antenna 20 of the first embodiment, the surface wave can be suppressed by a synergetic effect of the cavity structure and the conducting rim 32.

As shown in FIG. 4B, the plurality of metal posts 30 can be realized by forming a plurality of holes 301 thereby piercing through the dielectric substrate 21, and forming a plurality of hollow metal posts 30' thereby plating (through-hole plating) to inner walls of the plurality of holes 301.

In this case, lower end portions of the plurality of hollow metal posts 30' formed by the through-hole plating are connected to the ground conductor 22 through lands 302. The land 302 is formed on one end side of the dielectric substrate 21 by the pattern printing technique.

Structural parameters of each portion and simulation result obtained by changing the structural parameters for the characteristic of the linearly polarized antenna 20 will be described in order to explain the effect of suppressing the surface wave by the cavity structure and the conducting rim 32.

A factor which becomes the structural parameter of each portion will be described.

Figure 6:
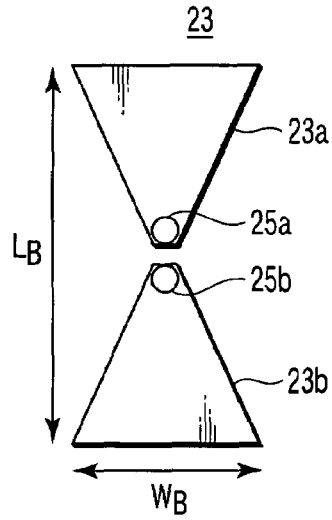
FIG. 6 is an enlarged front view showing the configuration of a main part of the linearly polarized antenna according to the first embodiment of the invention.

The frequency of 26 GHz in UWB is used in the linearly polarized antenna 20. As shown in FIG. 6, the dipole antenna element 23 includes a pair of input terminals 25*a* and 25*b*, and a triangular bow-tie antenna is used as the dipole antenna element 23. The triangular bow-tie antenna has a horizontal width $W_B$ of about 1.8 mm and an overall length $L_B$ of about 3.5 mm.

In the following descriptions and embodiments, a triangular example is shown as the antenna element 23 which should be adopted as the linearly polarized antenna 20.

Figure 7:
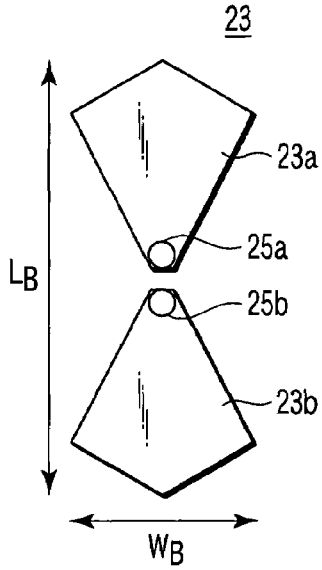
FIG. 7 is an enlarged front view showing the configuration of a modification of the main part of the linearly polarized antenna according to the first embodiment of the invention.

As shown in FIG. 7, in place of the triangular shape, a deformed rhombic antenna element 23 can also be used as the dipole antenna element 23 which should be adopted as the linearly polarized antenna 20. The deformed rhombic antenna element 23 includes the pair of input terminals 25*a* and 25*b*, and has a predetermined projection width $W_B$ and an overall length $L_B$.

The dielectric substrate 21 has a square outer shape while a central hub of the antenna element 23 is centered on the square shape. As shown in FIG. 2, the square shape has a side of L (hereinafter referred to as outline length), and the cavity is also formed in the square shape having the same central hub.

As shown in FIGS. 4A and 4B, an internal dimension of the cavity is set to Lw, and a distance (hereinafter referred to as rim width) extended inward from a cavity inner wall of the conducting rim 32 is set to $L_R$.

The diameter of each of the plurality of metal posts 30 forming the cavity is 0.3 mm, and the interval between the plurality of metal posts 30 is 0.9 mm.

Figure 8:
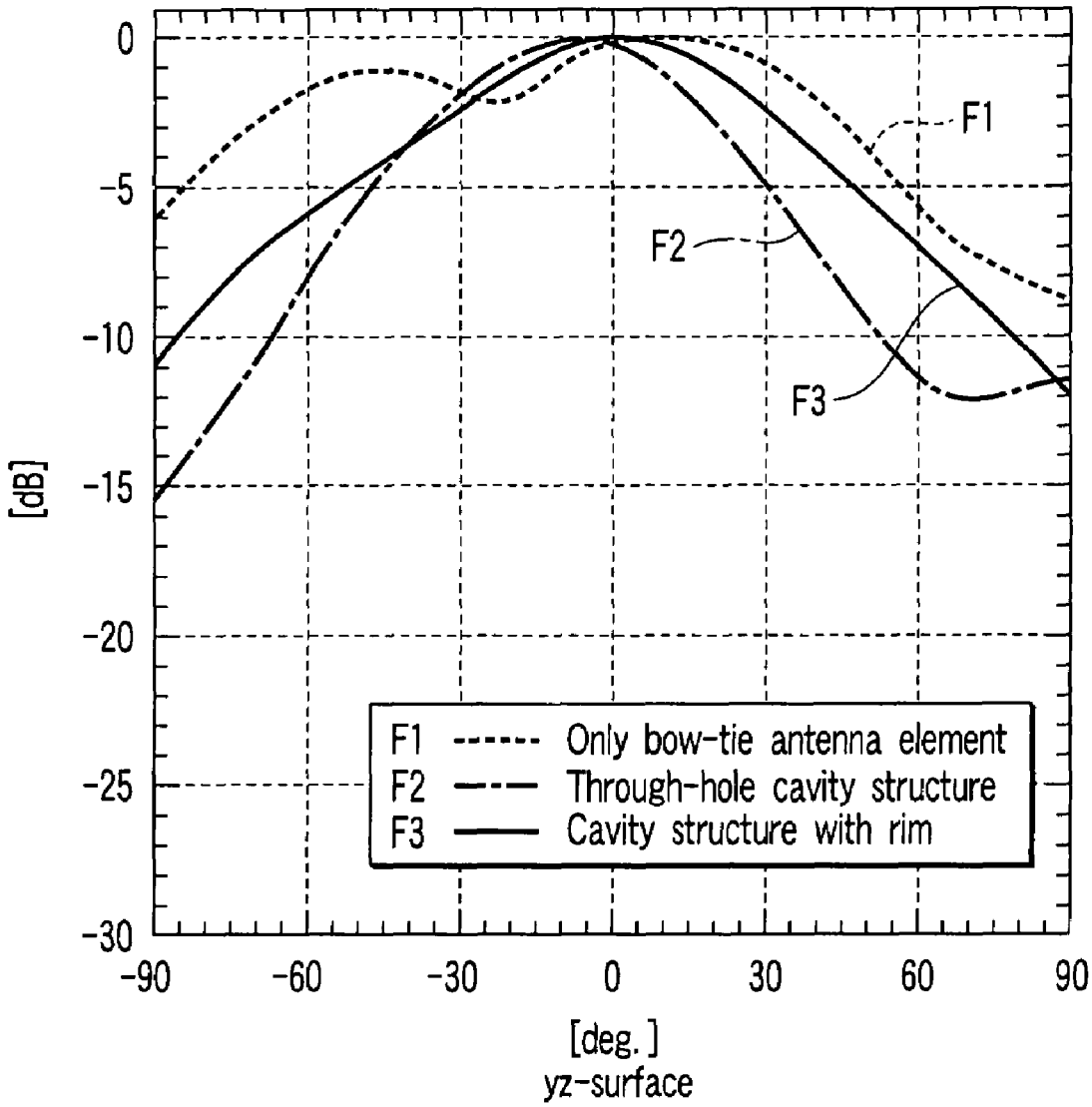
FIG. 8 is a characteristic view showing the case where the configuration of the main part of the linearly polarized antenna according to the first embodiment of the invention is removed and the case where the configuration of the main part is used.

FIG. 8 shows radiation directivity in a perpendicular surface (yz-surface in FIGS. 1 and 2) of each of three types of antennas in which the bow-tie antenna is used.

In FIG. 8, the numeral F1 designates the simulation result of the radiation directivity when the cavity by the plurality of metal posts 30 and the conducting rim 32 are not provided.

The numeral F2 designates the radiation directivity when the cavity is provided by the plurality of metal posts 30 while the conducting rim 32 is not provided.

The numeral F3 designates the radiation directivity when both the cavity by the plurality of metal posts 30 and the conducting rim 32 are provided.

A broad single-peaked characteristic which is symmetrical in relation to the direction of 0° is required for the radiation characteristic of the linearly polarized antenna.

As is clear from FIG. 8, in the radiation directivity F1 in which the cavity by the plurality of metal posts 30 and the conducting rim 32 are not provided, asymmetry becomes large in relation to the direction of 0°, and the directivity does not have the single-peaked characteristic.

As easily anticipated, this is attributed to the fact that the wave excited by the bow-tie antenna is diffused as the surface wave in the dielectric substrate 21 because the cavity by the plurality of metal posts 30 does not exist.

On the other hand, in the radiation directivity F2 in which the cavity is provided by the plurality of metal posts 30 while the conducting rim 32 is not provided, because the cavity by the plurality of metal posts 30 exists, it is assumed that the antenna having the good characteristic is obtained. However, as shown in FIG. 8, actually the radiation directivity F2 also has the asymmetry in relation to the direction of 0°.

This means that the surface wave cannot be sufficiently suppressed only using the cavity by the plurality of metal posts 30.

On the other hand, in the radiation directivity F3 in which both the cavity by the plurality of metal posts 30 and the conducting rim 32 are provided, symmetry is obtained in relation to the direction of 0°, and the directivity has the broad single-peaked characteristic.

This is because the surface wave transmitted to the outside of the cavity is suppressed with both the cavity by the plurality of metal posts 30 and the conducting rim 32 to generate the radio wave radiation only from an opening of the cavity, and it is clear that the large effect is obtained by providing the conducting rim 32.

The rim width $L_R$ is determined by a simulation or an experiment in such a manner that, as described later, the notch is generated in the antenna gain in the RR radio-wave emission prohibited band while the surface wave is suppressed.

Typically, the rim width $L_R$ has a value of 1.2 mm.

The rim width $L_R$=1.2 mm corresponds substantially to a quarter of the wavelength of the surface wave.

That is, the portion having the rim width $L_R$=1.2 mm forms a transmission path having a length of $\lambda g/4$ ($\lambda g$ is a wavelength of waveguide) in which impedance becomes infinite for the surface wave when the post wall side is viewed from the front end side.

Accordingly, an electric current is not passed along the surface of the dielectric substrate 21, and the excitation of the surface wave is suppressed to prevent the fluctuation in the radiation characteristic by the electric-current blocking action.

Therefore, the setting of the rim width $L_R$ may be changed according to the frequency in the case where the linearly polarized antenna 20 is applied to frequency bands other than the above frequency band.

The linearly polarized antenna 20 of the first embodiment can be used in various communication systems in UWB.

Second Embodiment

The linearly polarized antenna 20 of the first embodiment may be arrayed in the case where the gain necessary for the UWB radar runs short or in the case where the beam needs to be narrowed.

Figure 9:
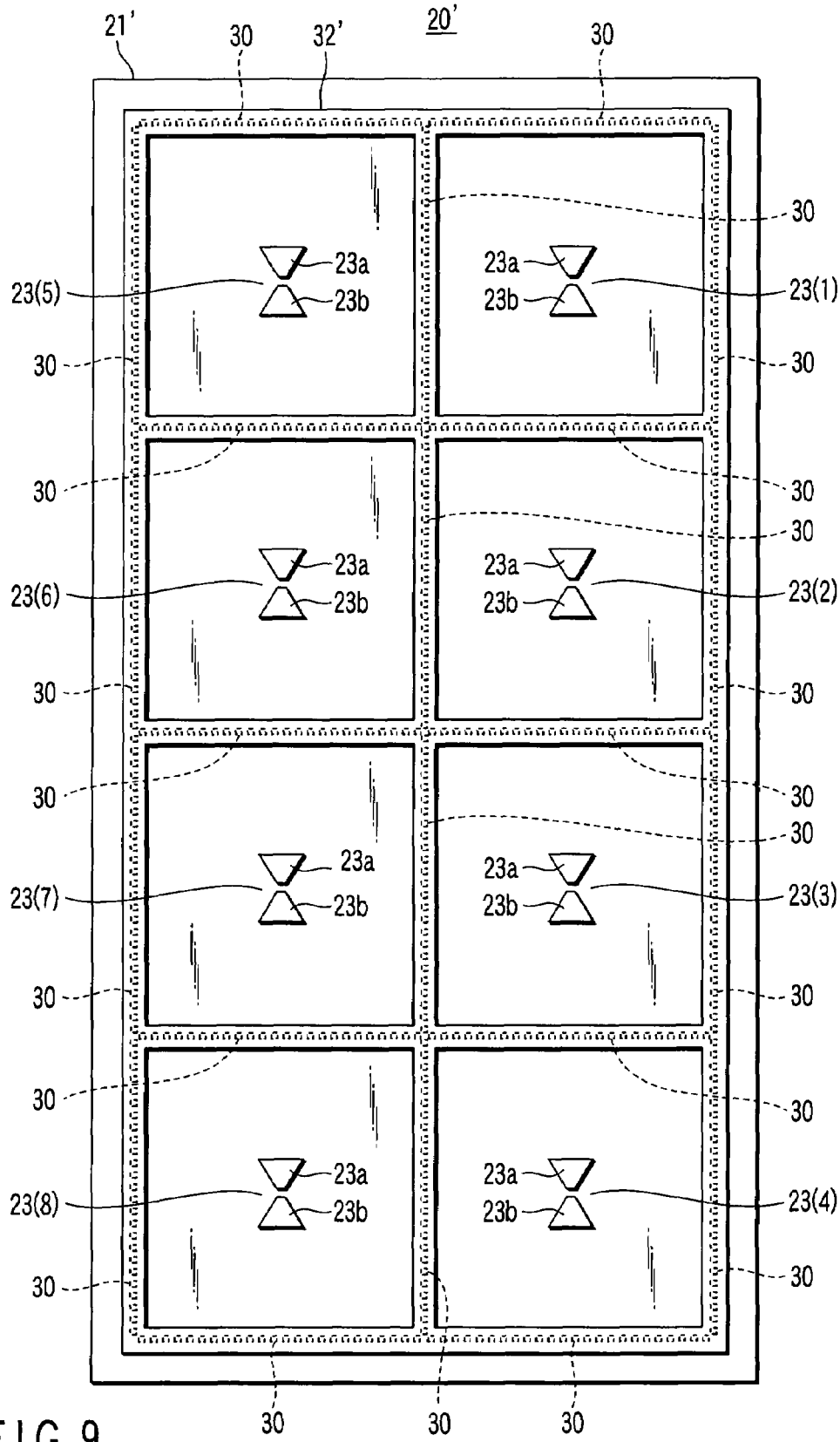
FIG. 9 is a front view showing a configuration of an array to which a linearly polarized antenna according to a second embodiment of the invention is applied.
Figure 10:
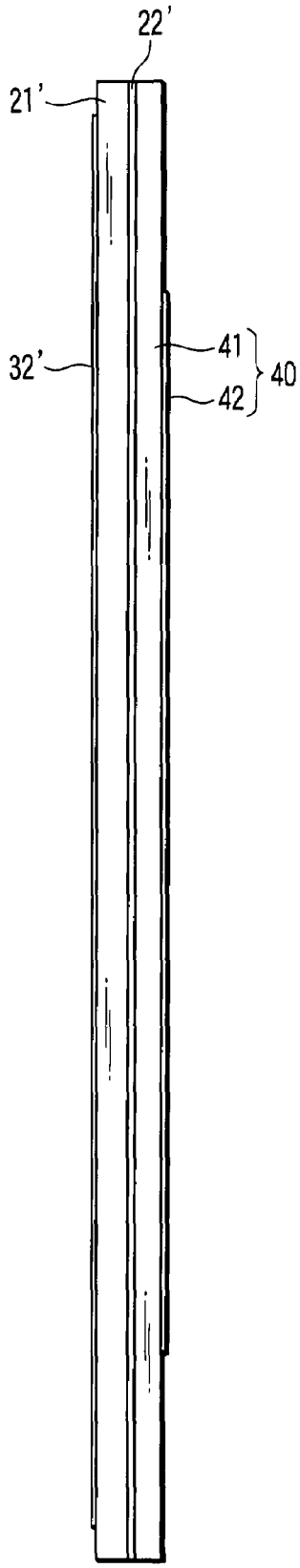
FIG. 10 is a side view showing the configuration of the array to which the linearly polarized antenna according to the second embodiment of the invention is applied.
Figure 11:
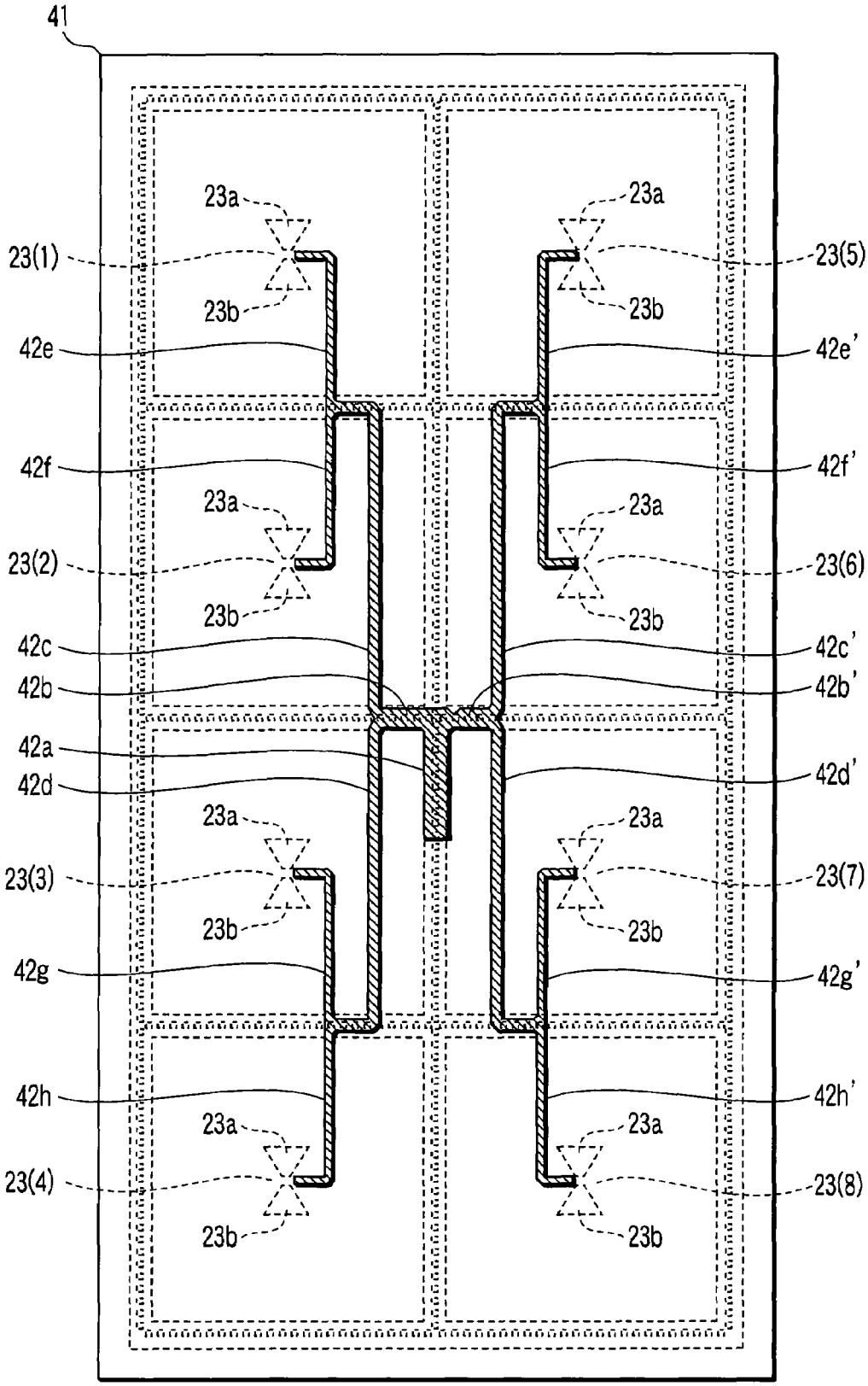
FIG. 11 is a rear view showing the configuration of the array to which the linearly polarized antenna according to the second embodiment of the invention is applied.

FIGS. 9 to 11 show a configuration of an arrayed linearly polarized antenna 20' which is a second embodiment of the linearly polarized antenna according to the invention.

FIG. 9 is a front view showing a configuration of an array to which the linearly polarized antenna according to the second embodiment of the invention is applied.

FIG. 10 is a side view showing the configuration of the array to which the linearly polarized antenna according to the second embodiment of the invention is applied.

FIG. 11 is a rear view showing the array to which the linearly polarized antenna according to the second embodiment of the invention is applied.

In the linearly polarized antenna 20' according to the second embodiment, a plurality sets of the antenna element 23 of the first embodiment are arrayed in two rows and four columns on common longitudinally rectangular dielectric substrate 21' and ground conductor 22'.

A feed unit 40 which distributes and feeds an excitation signal to the plurality sets of the antenna element 23 is formed on the side of the ground conductor 22' of the linearly polarized antenna 20'.

Eight antenna elements 23(1) to 23(8) which are the triangular bow-tie antenna formed in the same way as the first embodiment are provided in the two rows and four columns on the surface of the dielectric substrate 21'.

Similar to the first embodiment, each of the antenna elements 23(1) to 23(8) is surrounded by the cavity formed by arranging the plurality of metal posts 30 whose one end sides are connected to the ground conductor 22'.

In the antenna elements 23(1) to 23(8), the plurality of metal posts 30 are coupled to one another along the line direction on the other side of each of the plurality of metal posts 30 by a conducting rim 32'. The conducting rim 32' is extended by a predetermined distance (the rim width $L_R$) toward the direction of the antenna element 23 from the connection point to each of the plurality of metal posts 30.

That is, each of the antenna elements 23(1) to 23(8) is configured to suppress the generation of the surface wave.

In the case where the plurality of antenna elements 23(1) to 23(8) are arranged longitudinally and horizontally like the linearly polarized antenna 20', the cavity and conducting rim 32' which are provided between the adjacent antenna elements are commonly used, and the linearly polarized antenna 20' can be formed in a lattice shape as a whole.

However, the conducting rim 32' provided between the two adjacent antenna elements is formed so as to be extended by the predetermined distance (the rim width $L_R$) toward the both antenna elements.

One end of each of feed pins 25(1) to 25(8) is connected to a feed point of each of the antenna elements 23(1) to 23(8). Each of the feed pins 25(1) to 25(8) pierces through the dielectric substrate 21' and passes through a hole 22*a'* of the ground conductor 22' in a non-conductive manner. Then, each of the feed pins 25(1) to 25(8) pierces through a feeding dielectric substrate 41 constituting the feed unit 40 and the other end side of each of the feed pins 25(1) to 25(8) is projected to the surface of the feeding dielectric substrate 41.

As shown in FIG. 11, microstrip feed lines 42(*a*) to 42(*h*) and 42(*b'*) to 42(*h'*) are formed on the surface of the feeding dielectric substrate 41 while grounded to the ground conductor 22'.

The feed lines 42(*a*) to 42(*h*) and 42(*b'*) to 42(*h'*) include two feed lines 42*b* and 42*b'*, two lines 42*c* and 42*d*, and four feed lines 42*e* to 42*h*. The two feed lines 42*b* and 42*b'* are horizontally branched out from an input and output feed line 42*a* connected to a transmitting unit (not shown) or a receiving unit (not shown). The two lines 42*c* and 42*d* are vertically branched out from the line 42*b* extended leftward. The four feed lines 42*e* to 42*h* are branched out from the two lines 42*c* and 42*d*.

In FIG. 11, the four feed lines 42*e* to 42*h* are connected to the feed pins 25(1) to 25(4) of the antenna elements 23(1) to 23(4) in the right row.

Substantially similar to the left-side line 42*b*, the line 42*b'* branched out rightward from the input and output feed line 42*a* has vertically branched two feed lines 42*c'* and 42*d'* and four feed lines 42*e'* to 42*h'* branched out from the two lines 42*c'* and 42*d'*.

In FIG. 9, the four feed lines 42*e'* to 42*h'* are connected to the feed pins 25(5) to 25(8) of the antenna elements 23(5) to 23(8) in the left row.

Because the line lengths to the feed pins 25(1) to 25(8) are equally set when viewed from the input and output feed line 42*a*, the power is fed to the antenna element in the same phase, and a radiation beam is orientated toward the front of the antenna.

In the linearly polarized antenna 20' of the second embodiment having the above configuration, the generation of the surface wave is suppressed by the cavity and conducting rim 32' formed by the plurality of metal posts 30 in each antenna element 23. Therefore, similar to the first embodiment, mutual connection between the elements is decreased to obtain the desired radiation characteristic which is the single-peaked directivity.

In the linearly polarized antenna 20' of the second embodiment, beam spread in a vertical plane can appropriately be narrowed because the antenna elements are longitudinally arrayed in four columns, and the radiation in the high-elevation-angle direction which becomes problematic can be suppressed even if the component of the RR radio-wave emission prohibited band in the UWB band is included. Therefore, the linearly polarized antenna 20' of the second embodiment also has the effect of reducing the interruption to the RR radio-wave emission prohibited band.

In the feed unit 40 of the arrayed linearly polarized antenna 20', the excitation signal is distributed and fed to each antenna element by the microstrip feed line 42 formed on the feeding dielectric substrate 41. Alternatively, the feed unit can be formed by a coplanar line.

In this case, similarly there may be adopted either the method of forming the coplanar line type feed line on the surface of the feeding dielectric substrate 41 or the method of directly forming the coplanar line type feed line in the ground conductor 22'.

Particularly, in the latter method, there is an advantage that the feeding dielectric substrate 41 can be omitted.

In the linearly polarized antenna of the invention, it can be thought that a resonator is formed by providing the cavity, formed by the plurality of metal posts 30, and the conducting rim 32 in the dielectric substrate 21 and the resonator is excited by the linearly polarized antenna element 23.

Because the resonator is formed in the linearly polarized antenna of the invention, a resonance frequency exists, and input impedance of the linearly polarized antenna is largely increased to eliminate the radiation in the resonance frequency.

In this case, the resonance frequency of the resonator is determined by the structural parameters of the resonator and the linearly polarized antenna element.

As described above, examples of the structural parameters include the number of turns of the element antenna, a basic length a0 of the element, and a line width W in addition to the internal dimension Lw of the cavity and the rim width $L_R$.

Accordingly, the steep decline (notch) is rapidly generated near the resonance frequency in the frequency characteristic of the antenna gain.

When the resonance frequency is matched with the RR radio-wave emission prohibited band (23.6 to 24.0 GHz), the antenna as transmitting antenna of the UWB radar can be used to largely reduce the interference with the earth exploration satellite and the like.

However, because the notch is generally the narrow band, in consideration of production error, it is important to sufficiently broaden the band of the notch in order to cover the RR radio-wave emission prohibited band.

Third Embodiment

A third embodiment of a linearly polarized antenna according to the invention in which a configuration to broaden the band of the notch is adopted will be described below.

Figure 12A:
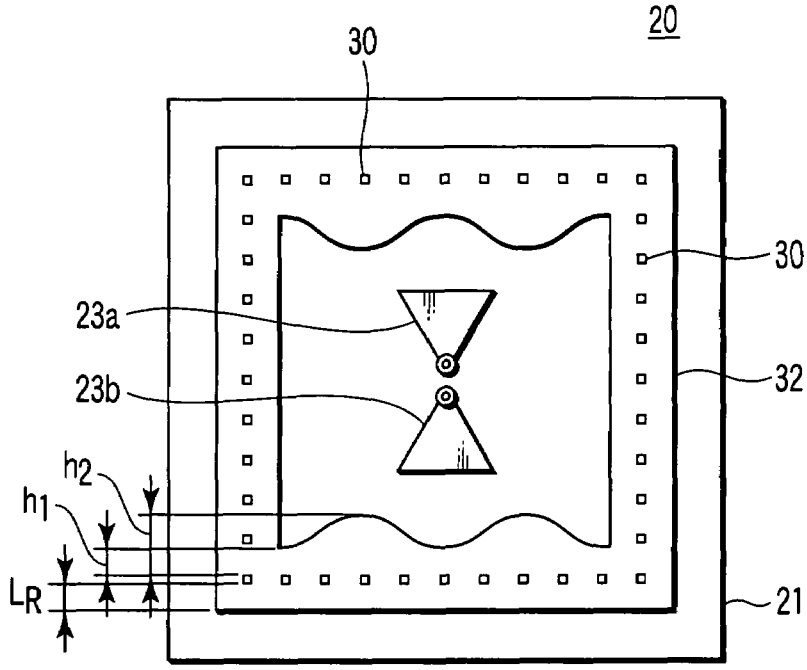
FIG. 12A is an enlarged front view showing a configuration of a main part to which a linearly polarized antenna according to a third embodiment of the invention is applied.
Figure 12B:
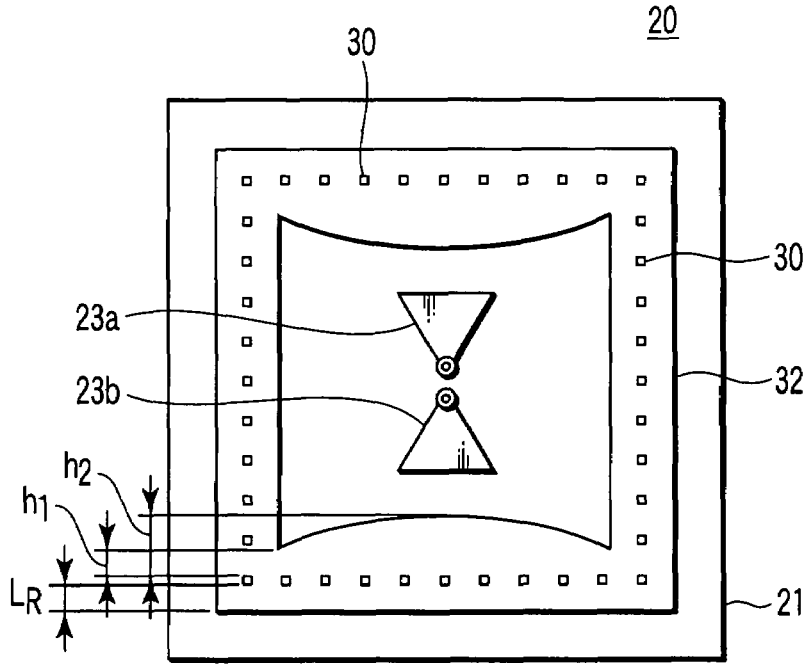
FIG. 12B is an enlarged front view showing a configuration of a modification of the main part to which the linearly polarized antenna according to the third embodiment of the invention is applied.
Figure 12C:
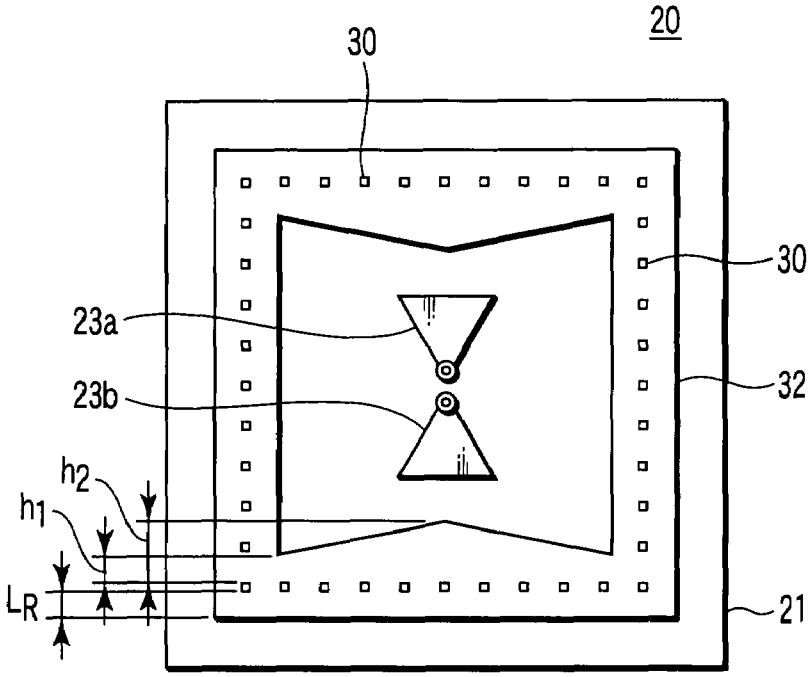
FIG. 12C is an enlarged front view showing a configuration of another modification of the main part to which the linearly polarized antenna according to the third embodiment of the invention is applied.

FIGS. 12A to 12C are enlarged front views showing a configuration of a main part to which a linearly polarized antenna 20 according to the third embodiment of the invention is applied and configurations of two different modifications.

Each of the linearly polarized antenna 20 shown in FIGS. 12A, 12B, and 12C is characterized in that the width of a conducting rim 32 is unevenly formed.

The linearly polarized antenna 20 of FIG. 12A shows an example in the case where a wave shape is formed as any shape which can be taken to unevenly form the width of the conducting rim 32.

The linearly polarized antenna 20 of FIG. 12B shows an example in the case where an arc is formed as any shape which can be taken to unevenly form the width of the conducting rim 32.

The linearly polarized antenna 20 of FIG. 12C shows an example in the case where a triangle is formed as any shape which can be taken to unevenly form the width of the conducting rim 32.

As shown in FIG. 2, in the case where the conducting rim 32 is formed in the square even width, a $\lambda/4$ transmission path having the infinite impedance is formed to extremely sharpen the resonance in the resonance frequency when viewed from the front end side to the post wall side. On the other hand, as shown in FIGS. 12A, 12B, and 12C, the resonance becomes duller by unevenly forming the width of the conducting rim 32.

Figure 13:
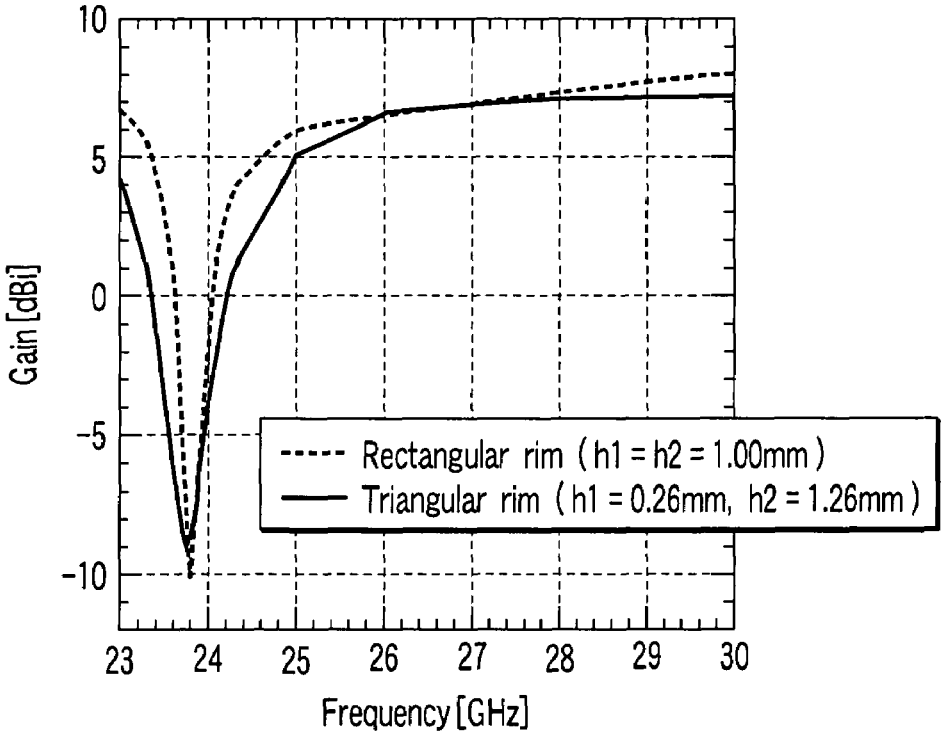
FIG. 13 is a characteristic view showing the use of the configuration of the main part to which the modification of the linearly polarized antenna according to the third embodiment of the invention shown in FIG. 12C is applied and the use of the configuration of the main part to which the linearly polarized antenna according to the first embodiment of the invention shown in FIG. 2 is applied.

FIG. 13 is a view explaining the effect in the case where the conducting rim 32 is formed in the triangular shape as shown in FIG. 12C. The conducting rim 32 shown in FIG. 12C has the simplest configuration in the linearly polarized antennas 20.

In this case, specifically h1 is set to about 0.26 mm, and h2 is set to about 1.26 mm in FIG. 12C.

In FIG. 13, a broken line indicates the frequency characteristic of the antenna gain in the case of the conducting rim 32 having the square even width whose rim width is $L_R$=1.0 mm as shown in FIG. 2.

A solid line indicates the frequency characteristic of the antenna gain in the case of the conducting rim 32 having the triangular uneven width of h1=0.26 mm and h2=1.26 mm as shown in FIG. 12C.

As is clear from FIG. 13, a frequency width at the position where the gain at 26 GHz is decreased by 10 dBi is about 260 MHz in the case of the square conducting rim 32 indicated by the broken line, whereas the frequency width is at least 500 MHz in the case of the triangular conducting rim 32 indicated by the solid line.

That is, because the RR radio-wave emission prohibited band has the width of 400 MHz, the RR radio-wave emission prohibited band having the width of 400 MHz is not sufficiently covered with the bandwidth of the notch in the case of the square conducting rim 32 shown by the broken line. On the other hand, the RR radio-wave emission prohibited band having the width of 400 MHz is sufficiently covered with the bandwidth of the notch in the case of the triangular conducting rim 32 shown by the solid line.

Fourth Embodiment

Figure 14:
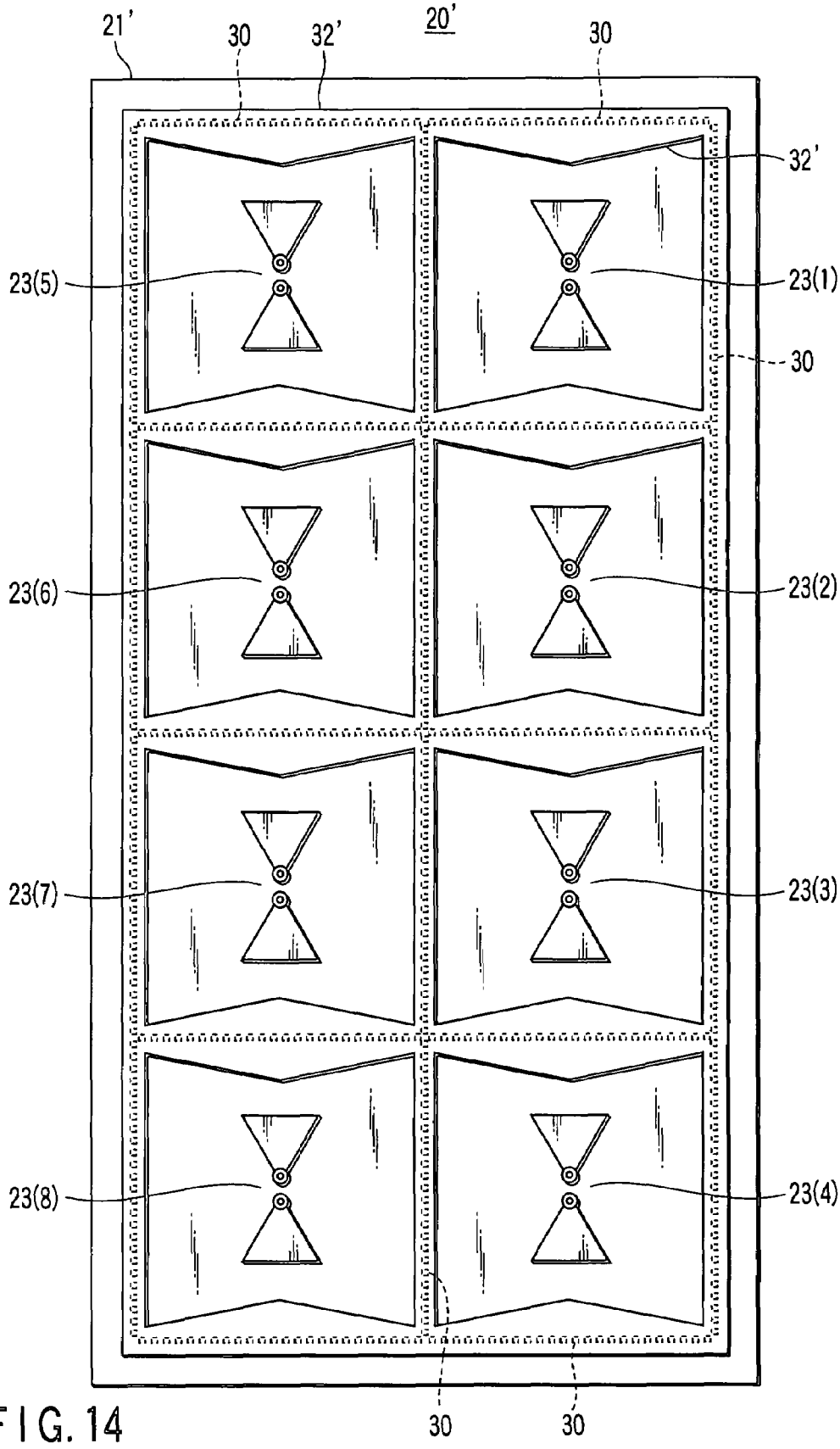
FIG. 14 is a front view showing a configuration of an array to which a linearly polarized antenna according to a fourth embodiment of the invention is applied.

FIG. 14 is a front view showing a configuration of a main part to which a linearly polarized antenna according to a fourth embodiment of the invention is applied.

That is, in the linearly polarized antenna to which the fourth embodiment is applied, as shown in FIG. 12C, the array antenna is formed with the antenna elements in which the conducting rims 32 are formed in the triangular shapes.

The configuration of the array antenna shown in FIG. 14 is a 2×4 element array similar to that of FIG. 9.

Figure 15:
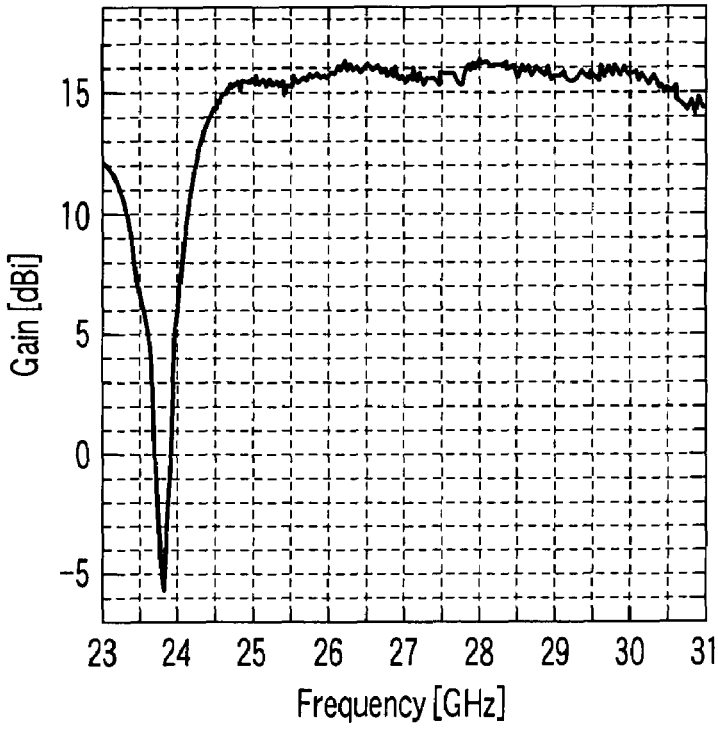
FIG. 15 is a characteristic view showing the use of the configuration of the array to which the linearly polarized antenna according to the fourth embodiment of the invention is applied.

FIG. 15 shows a frequency characteristic of an antenna gain of the array antenna shown in FIG. 14.

In the example, the gain is kept at 15 dBi in the range of 25 to 29 GHz, the steep notch where the gain is decreased by at least about 10 dBi from the peak level is generated in the range of 23.6 to 24.0 GHz, and the necessary bandwidth is obtained in the notch.

In the linearly polarized antenna of the invention, the RR radio-wave emission prohibited band can be covered with the frequency in which the notch is generated and the bandwidth of the notch by appropriately selecting one of the structural parameters of the resonator, the conducting rim, and the bow-tie antenna element.

Thus, in the linearly polarized antenna of the invention, the frequency in which the notch is generated can be matched with the RR radio-wave emission prohibited band by appropriately selecting one or both the structural parameters of the resonator and the antenna element.

In addition to the above basic configuration, the linearly polarized antenna of the invention is characterized in that preferably the antenna elements 23 and 23' are formed by the dipole antenna elements 23 and 23' having the pair of input terminals 25*a* and 25*b*, the feed pin 25 is further provided, one end side of the feed pin 25 is connected to one of the pair of input terminals 25*a* and 25*b* of the dipole antenna elements 23 and 23', the other side of the feed pin 25 pierces through the dielectric substrates 21 and 21' and the ground conductors 22 and 22', and the other of the pair of input terminals 25*a* and 25*b* of the dipole antenna elements 23 and 23' pierces through the dielectric substrates 21 and 21' and short-circuits the ground conductors 22 and 22'.

In addition to the above basic configuration, the linearly polarized antenna of the invention is characterized in that preferably the conducting rims 32 and 32' have at least a pair of uneven-width portions, e.g., a pair of triangular portions which is located across the antenna elements 23 and 23' from each other.

In addition to the above basic configuration, the linearly polarized antenna of the invention is characterized in that preferably a plurality of sets of the antenna elements 23 and 23' formed in the dielectric substrates 21 and 21' and a plurality of sets of the feed pins 25 whose one end is connected to one of the pair of input terminals 25*a* and 25*b* of the antenna elements 23 and 23' are provided, the plurality of metal posts 30 constituting the cavity and the conducting rims 32 and 32' are formed in the lattice shape so as to surround the plurality of sets of the antenna elements 23 and 23', and the feed unit 40 is further provided on the side of the ground conductors 22 and 22' to distribute and feed the excitation signal to the plurality of sets of the antenna elements 23 and 23' through the plurality of sets of the feed pin 25.

In addition to the above basic configuration, the linearly polarized antenna of the invention is characterized in that preferably the feed unit 40 is formed by the feeding dielectric substrate 41 and the microstrip feed line 42. The feeding dielectric substrate 41 is provided on the side opposite the dielectric substrates 21 and 21' across the ground conductors 22 and 22'. The microstrip feed line 42 is formed in the surface of the feeding dielectric substrate 41.

In addition to the above basic configuration, the linearly polarized antenna of the invention is characterized in that preferably each of the dipole antenna elements 23 and 23' is formed in the triangular shape while having the predetermined base width $W_B$ and the predetermined height $L_B/2$, and the dipole antenna elements 23 and 23' constitute the bow-tie antenna while vertexes thereof are arranged so as to face each other.

In addition to the above basic configuration, the linearly polarized antenna of the invention is characterized in that preferably each of the dipole antenna elements 23 and 23' is formed in the deformed rhombic shape while having the predetermined projection width $W_B$ and the predetermined height $L_B/2$, and the dipole antenna elements 23 and 23' constitute the bow-tie antenna while vertexes thereof are arranged so as to face each other.

In addition to the above basic configuration, the linearly polarized antenna of the invention is characterized in that preferably the resonator is formed by the cavity and the conducting rim, the structural parameters of the resonator and the antenna elements 23 and 23' are adjusted to set the resonator to the desired resonance frequency, and thereby the frequency characteristic is obtained such that the gain of the linearly polarized antenna is decreased in the predetermined range.

In addition to the above basic configuration, the linearly polarized antenna of the invention is characterized in that preferably the structural parameter includes at least one of the internal dimension Lw of the cavity, the rim width $L_R$ of the conducting rim, the overall lengths $L_B$ of the antenna elements 23 and 23', and the horizontal width $W_B$ of the antenna elements 23 and 23'.

Fifth Embodiment

Figure 16:
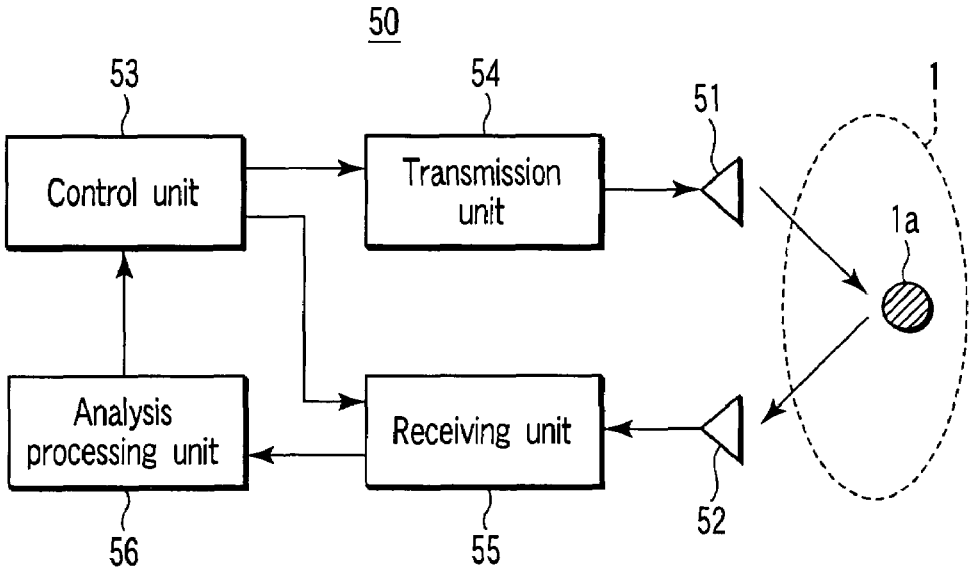
FIG. 16 is a block diagram showing a configuration of a radar apparatus to which a fifth embodiment of the apparatus is applied.

FIG. 16 is a block diagram showing a configuration of a radar apparatus to which a fifth embodiment of the invention is applied.

That is, FIG. 16 shows the configuration of a UWB radar apparatus 50 in which the linearly polarized antennas 20 and 20' of the above embodiments are used as a transmitting antenna 51 and a receiving antenna 52.

In the radar apparatus 50 shown in FIG. 16 which is a vehicle-mounted radar apparatus, a control unit 53 performs timing control of a transmitting unit 54, the transmitting unit 54 generates a pulse wave having a carrier frequency of 26 GHz at predetermined periods, and the transmitting antenna 51 radiates the pulse wave to a space 1 which is an exploration target.

The receiving antenna 52 receives the pulse wave reflected from an object 1*a* in the space 1, and the received signal is inputted to a receiving unit 55.

The control unit 53 performs timing control of the receiving unit 55, and the receiving unit 55 performs detection processing of the received signal.

The signal obtained by the detection processing is outputted to an analysis processing unit 56, analysis processing is performed to the space 1 of the exploration target, and the control unit 53 is notified of the analysis result if needed.

The linearly polarized antennas 20 and 20' can be used as the transmitting antenna 51 and receiving antenna 52 of the radar apparatus 50 having the above configuration.

In the case where the radar apparatus 50 is mounted on the vehicle, it is desirable that the transmitting antenna 51 and the receiving antenna 52 be integrally formed.

Figure 17:
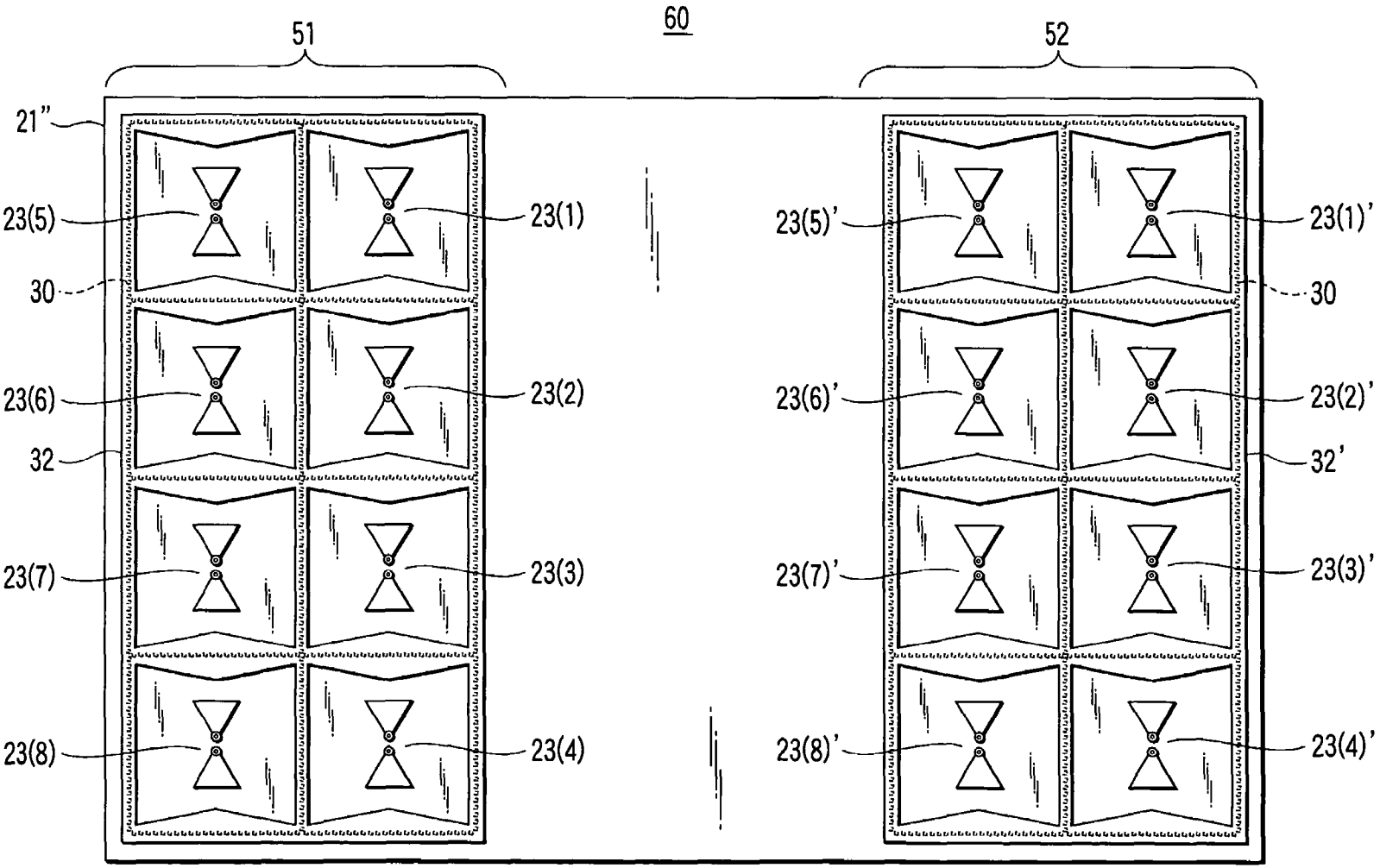
FIG. 17 is a front view showing a configuration of a linearly polarized antenna used in the radar apparatus to which the fifth embodiment of the apparatus is applied.
Figure 18:
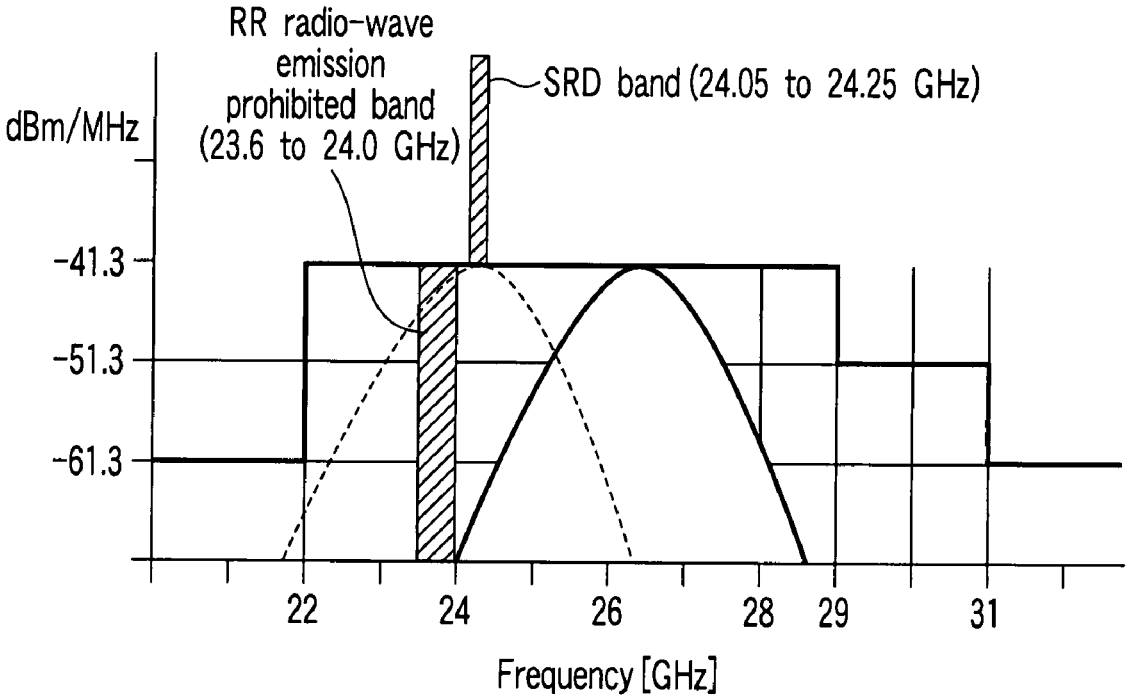
FIG. 18 (PRIOR ART)
FIG. 18 is a view showing a spectrum mask and a desirable working frequency band (recommended band) of a submillimeter wave band UWB.

FIG. 17 shows a linearly polarized antenna 60 formed in consideration of the above point. From the structural viewpoint, the transmitting antenna 51 and receiving antenna 52 formed by the first and second linearly polarized antennas 20' having the same configuration as the linearly polarized antenna 20' of FIG. 15 are provided on the right and left sides of a common landscape-oriented dielectric substrate 21".

FIG. 17 is a front view showing a configuration of the linearly polarized antenna 60 used in the radar apparatus to which the fifth embodiment of the apparatus is applied.

As described above, in the transmitting antenna 51 and receiving antenna 52 provided in the linearly polarized antenna 60, because each antenna element 23 is surrounded by the cavity structure formed by the plurality of metal posts 30 and the conducting rim 32', the surface wave has no influence on the transmitting antenna 51 and receiving antenna 52. Therefore, the transmitting antenna 51 and receiving antenna 52 have the broadband gain characteristics and the radiation to the RR radio-wave emission prohibited band is suppressed.

Furthermore, because each of feed units (not shown) of the transmitting antenna 51 and receiving antenna 52 of FIG. 17 has the array structure shown in FIG. 15, the good linearly polarized wave characteristic is obtained, and the receiving antenna 52 can receive the linearly polarized wave reflected from the object 1*a* with high sensitivity. The transmitting antenna 51 radiates the linearly polarized wave to the exploration space.

The equivalents to the linearly polarized antennas 20 and 20" may be adopted as the transmitting antenna 51 and receiving antenna 52 of the radar apparatus 50.

That is, the radar apparatus of the invention is characterized by basically including the transmitting unit 54 which radiates the radar pulse to the space 1 via the transmitting antenna 51, the receiving unit 55 which receives the radar pulse wave reflected from the space 1 via the receiving antenna 52, the analysis processing unit 56 which explores the object 1*a* existing in the space 1 based on the receiving output from the receiving unit 55, and the control unit 53 which controls at least one of the transmitting unit 54 and the receiving unit 55 based on the output from the analysis processing unit 56. In the radar apparatus, the transmitting antenna 51 and receiving antenna 52 are formed by the first and second linearly polarized antenna elements 23 and 23', the first and second linearly polarized antenna elements 23 and 23' respectively include dielectric substrates 21, 21', and 21", the ground conductors 22 and 22' which are overlapped on one side of each of the dielectric substrates 21, 21', and 21", the linearly polarized antenna elements 23 and 23' which are formed on the opposite surface of the dielectric substrates 21, 21', and 21", the plurality of metal posts 30 whose one end side is connected to the ground conductors 22 and 22', the plurality of metal posts 30 piercing through the dielectric substrates 21, 21', and 21" along the thickness direction, the other end side of the plurality of metal posts 30 being extended to the opposite surface of the dielectric substrates 21, 21', and 21", the plurality of metal posts 30 being provided at predetermined intervals to form the cavity so as to surround the antenna elements 23 and 23', and the conducting rims 32 and 32' which short-circuit the other end side of each of the plurality of metal posts 30 on the opposite surface side of the dielectric substrates 21, 21', and 21", the conducting rims 32 and 32' being provided while extended by a predetermined distance in the directions of the antenna elements 23 and 23'. One end side of each of the plurality of metal posts 30 is connected to the ground conductors 22 and 22', the plurality of metal posts 30 pierce through the dielectric substrate 21" along the thickness direction thereof, the other end of the plurality of metal posts 30 are extended to the opposite surface of the dielectric substrate 21", the plurality of metal posts 30 are provided at predetermined intervals to form the separated cavities such that the plurality of metal posts 30 surround the first linearly polarized antenna elements 23 and 23' and the second linearly polarized antenna elements 23 and 23' while separating the first linearly polarized antenna elements 23 and 23' and the second linearly polarized antenna elements 23 and 23', and the first conducting rim 32 and second conducting rim 32' are provided as the conducting rims 32 and 32' on the opposite surface of the dielectric substrate 21", the first conducting rim 32 and second conducting rim 32' short-circuiting the other end side of each of the plurality of metal posts 30 along the line direction of the plurality of metal posts 30, the plurality of metal posts 30 being provided at predetermined intervals so as to surround the first linearly polarized antenna elements 23 and 23' and the second linearly polarized antenna elements 23 and 23' while separating the first linearly polarized antenna elements 23 and 23' and the second linearly polarized antenna elements 23 and 23', the first conducting rim 32 and second conducting rim 32' being extended by the predetermined distance toward the directions of the first linearly polarized antenna elements 23 and 23' and the second linearly polarized antenna elements 23 and 23'.

In addition to the above basic configuration, the radar apparatus of the invention is characterized in that preferably the antenna elements 23 and 23' are formed by the dipole antenna elements 23 and 23' having the pair of input terminals 25*a* and 25*b*, the feed pin 25 is further provided, one end side of the feed pin 25 is connected to one of the pair of input terminals 25*a* and 25*b* of the dipole antenna elements 23 and 23', the other end side of the feed pin 25 pierces through the dielectric substrate 21" and the ground conductors 22 and 22', and the other of the pair of input terminals 25*a* and 25*b* of the dipole antenna elements 23 and 23' pierces through the dielectric substrate 21" and short-circuits the ground conductors 22 and 22'.

In addition to the above basic configuration, the radar apparatus of the invention is characterized in that preferably the conducting rims 32 and 32' have at least a pair of uneven-width portions, e.g., a pair of triangular portions which are located across the antenna elements 23 and 23' from each other.

In addition to the above basic configuration, the radar apparatus of the invention is characterized in that preferably a plurality of sets of the antenna elements 23 and 23' formed in the dielectric substrate 21" and a plurality of sets of the feed pin 25 whose one end is connected to one of the pair of input terminals 25*a* and 25*b* of the antenna elements 23 and 23' are provided, the plurality of metal posts 30 constituting the cavity and the conducting rims 32 and 32' are formed in the lattice shape so as to surround the plurality of sets of the antenna elements 23 and 23', and the feed unit 40 is further provided on the side of the ground conductors 22 and 22' to distribute and feed the excitation signal to the plurality of sets of the antenna elements 23 and 23' through the plurality of sets of the feed pin 25.

In addition to the above basic configuration, the radar apparatus of the invention is characterized in that preferably the feed unit 40 is formed by the feeding dielectric substrate 41 and the microstrip feed line 42. The feeding dielectric substrate 41 is provided on the side opposite the dielectric substrate 21" across the ground conductor 22 and 22'. The microstrip feed line 42 is formed in the surface of the feeding dielectric substrate 41.

In addition to the above basic configuration, the radar apparatus of the invention is characterized in that preferably each of the dipole antenna elements 23 and 23' is formed in the triangular shape while having the predetermined base width $W_B$ and the predetermined height $L_B/2$, and the dipole antenna elements 23 and 23' constitute the bow-tie antenna while vertexes thereof are arranged so as to face each other.

In addition to the above basic configuration, the radar apparatus of the invention is characterized in that preferably each of the dipole antenna elements 23 and 23' is formed in the deformed rhombic shape while having the predetermined projection width $W_B$ and the predetermined height $L_B/2$, and the dipole antenna elements 23 and 23' constitute the bow-tie antenna while vertexes thereof are arranged so as to face each other.

In addition to the above basic configuration, the radar apparatus of the invention is characterized in that preferably the resonator is formed by the cavity and the conducting rims 32 and 32', the structural parameters of the resonator and the antenna elements 23 and 23' are adjusted to set the resonator to the desired resonance frequency, and thereby the frequency characteristic is obtained such that the gain of the linearly polarized antenna is decreased in the predetermined range.

In addition to the above basic configuration, the radar apparatus of the invention is characterized in that preferably the structural parameter includes at least one of the internal dimension Lw of the cavity, the rim width $L_R$ of the conducting rims 32 and 32', the overall lengths $L_B$ of the antenna elements 23 and 23', and the horizontal width $W_B$ of the antenna elements 23 and 23'.

In addition to the above basic configuration, the linearly polarized antenna of the invention is characterized in that preferably the first linearly polarized antenna elements 23 and 23' and the second linearly polarized antenna elements 23' and 23 are formed as the antenna element in the dielectric substrate 21", one end side of each of the plurality of metal posts 30 is connected to the ground conductor 22, each of the plurality of metal posts 30 pierces through the dielectric substrate 21" along the thickness direction thereof, the other end side of each of the plurality of metal posts 30 is extended to the opposite surface of the dielectric substrate 21", the plurality of metal posts 30 are provided at predetermined intervals to form the separated cavities such that the plurality of metal posts 30 surround the first linearly polarized antenna elements 23 and 23' and the second linearly polarized antenna elements 23 and 23' while separating the first linearly polarized antenna elements 23 and 23' and the second linearly polarized antenna elements 23 and 23', and the first conducting rim 32 and second conducting rim 32' are provided as the conducting rims 32 and 32' on the opposite surface of the dielectric substrate 21", the first conducting rim 32 and second conducting rim 32' short-circuiting the other end side of each of the plurality of metal posts 30 along the line direction thereof, the plurality of metal posts 30 being provided at predetermined intervals so as to surround the first linearly polarized antenna elements 23 and 23' and the second linearly polarized antenna elements 23 and 23' while separating the first linearly polarized antenna elements 23 and 23' and the second linearly polarized antenna elements 23 and 23', the first conducting rim 32 and second conducting rim 32' being extended by the predetermined distance toward the directions of the first linearly polarized antenna elements 23 and 23' and the second linearly polarized antenna elements 23 and 23'.

In addition to the above basic configuration, the linearly polarized antenna of the invention is characterized in that preferably one of the first linearly polarized antenna element 23 or 23' and the second linearly polarized antenna element 23 or 23' is applied to the transmitting antenna 51 of the radar apparatus 50 while the other is applied to the receiving antenna 52 of the radar apparatus 50.

INDUSTRIAL APPLICABILITY

The fifth embodiment is the example in which the linearly polarized antenna of the invention is used as the UWB radar apparatus. In addition to the UWB radar apparatus, the linearly polarized antenna of the invention can also be applied to various communication systems in frequency bands other than UWB.

The invention claimed is:

1. A radar apparatus comprising:

a transmitting unit which radiates a radar pulse to a space via a transmitting antenna;

a receiving unit which receives the radar pulse reflected from an object existing in the space via a receiving antenna;

an analysis processing unit which explores the object existing in the space based on a receiving output from the receiving unit; and a control unit which controls at least one of the transmitting unit and the receiving unit based on an output from the analysis processing unit, wherein the transmitting antenna and the receiving antenna respectively comprise first and second linearly polarized antenna elements, and the first and second linearly polarized antenna elements respectively include:

a dielectric substrate;

a ground conductor which is overlapped on a first surface of the dielectric substrate;

a linearly polarized antenna element formed on a second surface of the dielectric substrate which is opposite to the first surface of the dielectric substrate;

a plurality of metal posts in which a first end side of each of the plurality of metal posts is connected to the ground conductor, and pierces through the dielectric substrate along a thickness direction thereof, wherein a second end side of each of the plurality of metal posts is extended to the second surface of the dielectric substrate, and the plurality of metal posts are provided at predetermined intervals to form a cavity so as to surround the antenna element; and a conducting rim which short-circuits the second end side of each of the plurality of metal posts along a line direction of the plurality of metal posts on the second surface of the dielectric substrate, wherein the conducting rim extends by a predetermined distance in a direction of the antenna element, wherein the plurality of metal posts are provided at the predetermined intervals to form separated cavities such that the plurality of metal posts surround the first linearly polarized antenna element and the second linearly polarized antenna element while separating the first linearly polarized antenna element and the second linearly polarized antenna element, and wherein a first conducting rim and a second conducting rim are provided on the second surface of the dielectric substrate, the first conducting rim and the second conducting rim short-circuiting the second end side of each of the plurality of metal posts along the line direction of the plurality of metal posts, and the first conducting rim and the second conducting rim being extended by the predetermined distance toward the directions of the first linearly polarized antenna element and the second linearly polarized antenna element.

2. The radar apparatus according to claim 1, wherein:

each of the first and second antenna elements is formed by a dipole antenna element having a pair of input terminals, each of the antennas further comprises a feed pin in which a first end side is connected to one of the pair of input terminals of the corresponding dipole antenna element while a second end side is provided to pierce through the dielectric substrate and the corresponding ground conductor, and the other of the pair of input terminals of each of the dipole antenna elements pierces through the dielectric substrate to short-circuit the corresponding ground conductor.

3. The radar apparatus according to claim 2, wherein:

each of the antennas comprises a plurality of the linearly polarized antenna elements formed on the dielectric substrate and a plurality of the feed pins in which a first end of each of the feed pins is connected to one of the pair of input terminals of the corresponding antenna elements, the plurality of metal posts and the conducting rim are formed in a lattice shape so as to surround the plurality of antenna elements, and each of the antennas further comprises a feed unit which is provided on a side of the corresponding ground conductor to distribute and feed an excitation signal to the corresponding plurality of the antenna elements via the corresponding plurality of the feed pins.

4. The radar apparatus according to claim 3, wherein the feed unit is formed by a feeding dielectric substrate and a microstrip feed line, the feeding dielectric substrate being provided on a side opposite the dielectric substrate across the ground conductor, and the microstrip feed line being formed on a surface of the feeding dielectric substrate.

5. The radar apparatus according to claim 2, wherein each of the dipole antenna elements is formed in a triangular shape having a predetermined base width $W_B$ and a predetermined height $L_B/2$, and wherein each of the dipole antenna elements forms a bow-tie antenna having vertexes thereof arranged so as to face each other.

6. The radar apparatus according to claim 2, wherein each of the dipole antenna elements is formed in a deformed rhombic shape having a predetermined projection width $W_B$ and a predetermined height $L_B/2$, and wherein each of the dipole antenna elements forms a bow-tie antenna having vertexes thereof arranged so as to face each other.

7. The radar apparatus according to any one of claims 1 to 6, wherein a resonator is formed by the cavity and the conducting rim, and structural parameters of the resonator and the corresponding antenna element are adjusted to set the resonator to a desired resonance frequency, and thereby a frequency characteristic is obtained such that a gain of the corresponding linearly polarized antenna is decreased in a predetermined range.

8. The radar apparatus according to claim 7, wherein the structural parameters include at least one of a internal dimension Lw of the cavity, a rim width $L_R$ of the conducting rim, an overall length $L_B$ of the corresponding antenna element, and a horizontal width $W_B$ of the corresponding antenna element.

9. The radar apparatus according to claim 1, wherein the conducting rim has at least a pair of uneven-width portions which are provided across the antenna element from each other.

10. The radar apparatus according to claim 9, wherein the pair of uneven-width portions is a pair of triangular portions.

11. A linearly polarized antenna comprising:

a dielectric substrate;

a ground conductor which is overlapped on a first surface of the dielectric substrate;

a linearly polarized antenna element formed on a second surface of the dielectric substrate which is opposite to the first surface of the dielectric substrate;

a plurality of metal posts in which a first end side of each of the plurality of metal posts is connected to the ground conductor, and pierces through the dielectric substrate along a thickness direction thereof, wherein a second end side of each of the plurality of metal posts is extended to the second surface of the dielectric substrate, and the plurality of metal posts are provided at predetermined intervals to form a cavity so as to surround the antenna element; and a conducting rim which short-circuits the second end side of each of the plurality of metal posts along a line direction of the plurality of metal posts on the second surface of the dielectric substrate, wherein the conducting rim is extended by a predetermined distance toward a direction of the antenna element, and wherein the conducting rim has at least a pair of uneven-width portions provided across the antenna element from each other.

12. The linearly polarized antenna according to claim 11, wherein the pair of uneven-width portions is a pair of triangular portions.

13. The linearly polarized antenna according to claim 11, wherein:

a plurality of the linearly polarized antenna elements are formed on the dielectric substrate and a plurality of feed pins are provided in which a first end of each of the feed pins is connected to one of a pair of input terminals of the antenna elements;

the plurality of metal posts and the conducting rim are formed in a lattice shape so as to surround the plurality of the antenna elements; and the linearly polarized antenna further comprises a feed unit which is provided on a side of the ground conductor to distribute and feed an excitation signal to the plurality of antenna elements through the plurality of feed pins.

14. The linearly polarized antenna according to claim 13, wherein the feed unit comprises a feeding dielectric substrate and a microstrip feed line, the feeding dielectric substrate being provided on a side opposite the dielectric substrate across the ground conductor, and the microstrip feed line being formed on a surface of the feeding dielectric substrate.

15. The linearly polarized antenna according to claim 11, wherein:

a first linearly polarized antenna element and a second linearly polarized antenna element are formed on the dielectric substrate;

the plurality of metal posts are provided at the predetermined intervals to form separated cavities such that the plurality of metal posts surround the first linearly polarized antenna element and the second linearly polarized antenna element while separating the first linearly polarized antenna element and the second linearly polarized antenna element; and a first conducting rim and a second conducting rim are provided on the second surface of the dielectric substrate, the first conducting rim and the second conducting rim short-circuiting the second end side of each of the plurality of metal posts along the line direction of the plurality of metal posts, and the first conducting rim and the second conducting rim being extended by the predetermined distance toward directions of the first linearly polarized antenna element and the second linearly polarized antenna element.

16. The linearly polarized antenna according to claim 15, wherein one of the first linearly polarized antenna element and the second linearly polarized antenna element is applied as a transmitting antenna of a radar apparatus and the other is applied as a receiving antenna of the radar apparatus.

17. A linearly polarized antenna comprising:

a dielectric substrate;

a ground conductor which is overlapped on a first surface of the dielectric substrate;

a linearly polarized antenna element formed on a second surface of the dielectric substrate which is opposite to the first surface of the dielectric substrate;

a plurality of metal posts in which a first end side of each of the plurality of metal posts is connected to the ground conductor, and pierces through the dielectric substrate along a thickness direction thereof, wherein a second end side of each of the plurality of metal posts is extended to the second surface of the dielectric substrate, and the plurality of metal posts are provided at predetermined intervals to form a cavity so as to surround the antenna element; and a conducting rim which short-circuits the second end side of each of the plurality of metal posts along a line direction of the plurality of metal posts on the second surface of the dielectric substrate, wherein the conducting rim is extended by a predetermined distance toward a direction of the antenna element; and wherein a resonator is formed by the cavity and the conducting rim, and structural parameters of the resonator and the antenna element are adjusted to set the resonator to a desired resonance frequency, so as to achieve a frequency characteristic such that a gain of the linearly polarized antenna is decreased in a predetermined range.

18. The linearly polarized antenna according to claim 17, wherein the conducting rim has at least a pair of uneven-width portions provided across the antenna element from each other.

19. The linearly polarized antenna according to claim 18, wherein the pair of uneven-width portions is a pair of triangular portions.

20. The linearly polarized antenna according to claim 17, wherein:

a plurality of the linearly polarized antenna elements are formed on the dielectric substrate and a plurality of feed pins are provided in which a first end of each of the feed pins is connected to one of a pair of input terminals of the antenna elements;

the plurality of metal posts and the conducting rim are formed in a lattice shape so as to surround the plurality of the antenna elements; and the linearly polarized antenna further comprises a feed unit which is provided on a side of the ground conductor to distribute and feed an excitation signal to the plurality of antenna elements through the plurality of feed pins.

21. The linearly polarized antenna according to claim 20, wherein the feed unit comprises a feeding dielectric substrate and a microstrip feed line, the feeding dielectric substrate being provided on a side opposite the dielectric substrate across the ground conductor, and the microstrip feed line being formed on a surface of the feeding dielectric substrate.

22. The linearly polarized antenna according to claim 17, wherein:

a first linearly polarized antenna element and a second linearly polarized antenna element are formed on the dielectric substrate;

the plurality of metal posts are provided at the predetermined intervals to form separated cavities such that the plurality of metal posts surround the first linearly polarized antenna element and the second linearly polarized antenna element while separating the first linearly polarized antenna element and the second linearly polarized antenna element; and a first conducting rim and a second conducting rim are provided on the second surface of the dielectric substrate, the first conducting rim and the second conducting rim short-circuiting the second end side of each of the plurality of metal posts along the line direction of the plurality of metal posts, and the first conducting rim and the second conducting rim being extended by the predetermined distance toward directions of the first linearly polarized antenna element and the second linearly polarized antenna element.

23. The linearly polarized antenna according to claim 22, wherein one of the first linearly polarized antenna element and the second linearly polarized antenna element is applied as a transmitting antenna of a radar apparatus and the other is applied as a receiving antenna of the radar apparatus.

24. The linearly polarized antenna according to claim 17, wherein the structural parameters include at least one of an internal dimension Lw of the cavity, a rim width $L_R$ of the conducting rim, an overall length $L_B$ of the antenna element, and a horizontal width $W_B$ of the antenna element.

* * * * *